US009229351B2

(12) United States Patent
Funatani et al.

(10) Patent No.: US 9,229,351 B2
(45) Date of Patent: Jan. 5, 2016

(54) IMAGE FORMING APPARATUS

(71) Applicant: CANON KABUSHIKI KAISHA, Tokyo (JP)

(72) Inventors: Kazuhiro Funatani, Mishima (JP); Hiroaki Sakai, Mishima (JP); Akimichi Suzuki, Yokohama (JP); Shuji Saito, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/658,297

(22) Filed: Oct. 23, 2012

(65) Prior Publication Data

US 2013/0108290 A1 May 2, 2013

(30) Foreign Application Priority Data

Oct. 26, 2011 (JP) ..... 2011-235136
Oct. 26, 2011 (JP) ..... 2011-235137
Sep. 21, 2012 (JP) ..... 2012-208468

(51) Int. Cl.
*G03G 15/00* (2006.01)
*G03G 15/043* (2006.01)
*G03G 15/08* (2006.01)
*G03G 15/01* (2006.01)

(52) U.S. Cl.
CPC ..... *G03G 15/043* (2013.01); *G03G 15/0189* (2013.01); *G03G 15/0813* (2013.01); *G03G 2215/0132* (2013.01)

(58) Field of Classification Search
CPC ..... G03G 15/043; G03G 15/08813; G03G 2215/0413; G03G 2215/0404
USPC ..... 399/43, 44, 46–48, 50, 51
See application file for complete search history.

(56) References Cited

U.S. PATENT DOCUMENTS

| | | | | |
|---|---|---|---|---|
| 5,570,166 | A * | 10/1996 | Ohzeki et al. | 399/270 |
| 7,400,840 | B2 * | 7/2008 | Hattori | 399/49 |
| 7,415,215 | B2 * | 8/2008 | Yamada | 399/38 |
| 2003/0215254 | A1 | 11/2003 | Otomo | |
| 2005/0002680 | A1 * | 1/2005 | Hattori | 399/49 |
| 2006/0285864 | A1 | 12/2006 | Hattori | |
| 2013/0004204 | A1 * | 1/2013 | Hagiwara et al. | 399/128 |
| 2013/0169731 | A1 * | 7/2013 | Mizuta et al. | 347/224 |

FOREIGN PATENT DOCUMENTS

| | | | |
|---|---|---|---|
| CN | 101145008 | A | 3/2008 |
| CN | 101154084 | A | 4/2008 |
| JP | 3-238477 | A | 10/1991 |
| JP | 5-273824 | A | 10/1993 |
| JP | 9-006151 | A | 1/1997 |

* cited by examiner

*Primary Examiner* — David Gray
*Assistant Examiner* — Carla Therrien
(74) *Attorney, Agent, or Firm* — Canon U.S.A., Inc. IP Division

(57) ABSTRACT

An image forming apparatus includes an exposure device having an adjustment period for adjusting an output while exposing a photosensitive drum to light prior to image formation and a developing device. The developing device is configured to change between a contact state where the photosensitive drum and a developing roller are in contact with each other and a separation state where they are separated from each other. The developing device changes from the separation state to the contact state when a portion on the photosensitive drum exposed to light in the adjustment period of the exposure device is at a developing position.

25 Claims, 26 Drawing Sheets

LASER LIGHTING STATE
FORCED LASER EMISSION
UNBLANKING EMISSION

TARGET ROTATION NUMBER
BD0
SCANNER ROTATION NUMBER
TIME

LASER BEAM AMOUNT
TIME

V1
DRUM SURFACE POTENTIAL
T1
T2
TIME

FORCED LIGHT EMISSION
LASER EMISSION
UNBLANKING EMISSION

CONTACT AFTER FORCED LIGHT EMISSION
CONTACT
DEVELOPING ROLLER CONTACT
SEPARATION
IMAGE FORMATION SETUP COMPLETED

DEVELOPING ROLLER CONTACT IN ADVANCE
CONTACT
DEVELOPING ROLLER CONTACT
SEPARATION
IMAGE FORMATION SETUP COMPLETED
IMAGE FORMATION SETUP STARTED
Time [sec]

LASER LIGHTING STATE
FORCED LASER EMISSION
UNBLANKING EMISSION

Vd_dc2
Vd_dc1
Vd1
VL1
Vdev
DRUM SURFACE POTENTIAL
DEVELOPING BIAS
CHARGING BIAS
CHARGING BIAS
PHOTOSENSITIVE DRUM POTENTIAL
DEVELOPING BIAS
TIME

DEVELOPING ROLLER CONTACT STATE
CONTACT
SEPARATION
TIME

LASER BEAM AMOUNT ON PHOTOSENSITIVE DRUM SURFACE
W2
IMAGE FORMATION SETUP STARTED
T2
T3
TIME

LASER LIGHTING STATE
FORCED LASER EMISSION
UNBLANKING EMISSION

CHARGING BIAS
Vd_dc1
PHOTOSENSITIVE DRUM POTENTIAL
DRUM SURFACE POTENTIAL
DEVELOPING BIAS
CHARGING BIAS
Vd3
Vd4
Vdev
DEVELOPING BIAS
TIME

DEVELOPING ROLLER CONTACT STATE
CONTACT
SEPARATION
TIME

LASER BEAM AMOUNT ON PHOTOSENSITIVE DRUM SURFACE
W2
W3
W4
IMAGE FORMATION SETUP STARTED
T2
T4
TIME

IMAGE FORMING APPARATUS

BACKGROUND OF THE INVENTION

1. Field of the Invention

The present disclosure relates to an image forming apparatus, such as copying machines, printers, and facsimiles employing the electrophotographic or electrostatic recording process.

2. Description of the Related Art

With the improved operating speed, functionality, and colorization of electrophotographic image forming apparatuses, diverse types of printers and copying machines have been placed on the market.

With the increase in operating speed of image forming apparatuses, the life of various parts has been prolonged. For example, as a general method for prolonging the life of an image forming unit employing the contact development process, a photosensitive drum is normally separated from a developing roller and contacts the developing roller only at the time of image formation. This configuration can reduce the time of contact between the photosensitive drum and the developing roller, thus degradation of both members is restrained and the life of the image forming unit is prolonged.

In addition, various measures are taken for image quality stabilization. In particular, various optical adjustments are applied to exposure devices. For example, a laser beam printer using a laser beam as an exposure device has a problem of the stabilization of the laser beam amount. Accordingly, a certain optical adjustment (hereinafter referred to as automatic power control (APC)) is generally performed. More specifically, a part of a laser beam is detected by a light-receiving element, and an amount of driving current flowing into a laser diode is changed based on the result of detection to control the laser beam amount. Performing APC before image formation enables the exposure device to constantly maintain a constant laser beam amount, thus a formed image can be prevented from becoming unstable by environmental change, laser variation, and degradation.

It is necessary to perform APC during laser emission. This means that an electrostatic latent image is formed on the photosensitive drum during execution of the APC. Therefore, if the developing roller contacts the photosensitive drum during execution of the APC, toner may be uselessly consumed (developed). For this reason, conventionally, the developing roller contacts the photosensitive drum after completion of APC and extinction of the laser, thus preventing wasteful toner consumption and stain on the rear surface of paper.

Japanese Patent Application Laid-Open No. 03-238477 discusses an image forming apparatus which is not provided with a mechanism for separating the developing roller from the photosensitive drum. Therefore, since the developing roller constantly contacts the photosensitive drum, during execution of the APC, a developing bias different from that at the time of image formation is set to prevent wasteful toner consumption.

In recent years, to reduce user stress, a time period since the image forming apparatus receives image data until an image is printed (hereinafter referred to as first print out time (FPOT)) has been thought as important. Since shortening FPOT reduces the turnover time of various parts, shortening FPOT has become an important subject also from the viewpoint of life extension. Therefore, the conventional configuration in which the developing roller contacts the photosensitive drum after completion of APC is not desirable because of an increase in FPOT.

With the configuration discussed in Japanese Patent Application Laid-Open No. 03-238477, toner may be consumed even if the developing bias during execution of the APC is controlled so that toner is not consumed. The reason will be described below. Generally, the photosensitive drum sensitivity varies, for example, according to individual differences and degradation thereof. In other words, irradiation of an identical laser beam amount does not necessarily provide the same potential on the photosensitive drum. Such variation in the photosensitive drum sensitivity may produce a potential difference between the photosensitive drum and the developing roller causing toner movement therebetween, possibly resulting in wasteful toner consumption.

SUMMARY OF THE INVENTION

The present disclosure relates to an image forming apparatus capable of not only shortening first print out time (FPOT) but also preventing wasteful toner consumption in an easy way.

According to an aspect as disclosed herein, an image forming apparatus includes an image bearing member, an exposure device configured to expose the image bearing member to light to form an electrostatic latent image on the image bearing member, the exposure device having an adjustment period for adjusting an output while exposing the image bearing member to light prior to image formation, and a developing device configured to include a toner bearing member for bearing toner, to change between a contact state where the image bearing member and the toner bearing member are in contact with each other and a separation state where they are separated from each other, and to develop the electrostatic latent image by toner on the toner bearing member in the contact state, wherein, if a portion on the image bearing member exposed to light in the adjustment period is at a developing position, the developing device changes from the separation state to the contact state.

Further features and aspects will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles disclosed herein.

DESCRIPTION OF THE EMBODIMENTS

Various exemplary embodiments, features, and aspects of the invention will be described in detail below with reference to the drawings.

An image forming apparatus according to the present invention will be described in more detail below with reference to the accompanying drawings.

Figure 1:
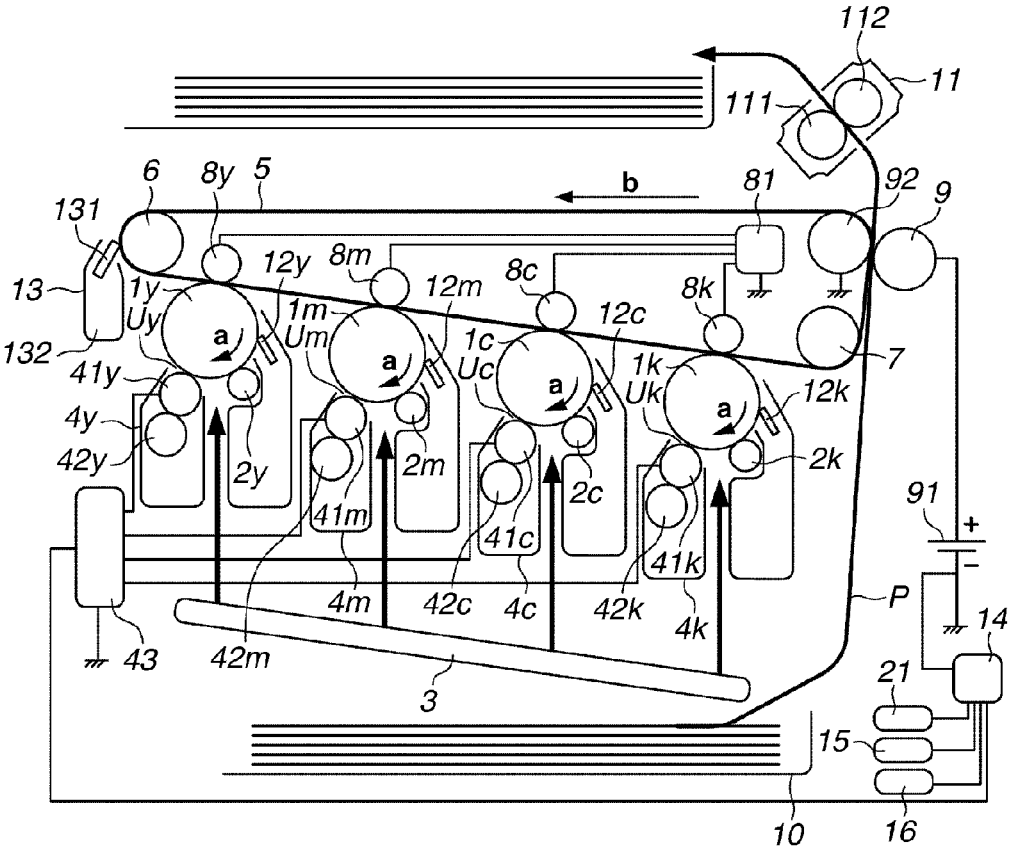
FIG. 1 illustrates an overall configuration of an image forming apparatus according to an exemplary embodiment.

FIG. 1 illustrates an overall configuration of an image forming apparatus (a color image forming apparatus, such as an electrophotographic tandem-type laser printer) according to a first exemplary embodiment. FIG. 1 illustrates an electrophotographic multicolor image forming apparatus according to the present exemplary embodiment. The image forming apparatus will be described in detail below with reference to the image forming processing. Each operation of the image forming apparatus to be described below is controlled by a central processing unit (CPU) 14 as a control unit.

As illustrated in FIG. 1, respective image forming units Uy, Um, Uc, and Uk for yellow, magenta, cyan, and black toner are arranged along a flat surface of an intermediate transfer belt 5 as an intermediate transfer member (image receiving member). Since the image forming units Uy, Um, Uc, and Uk include the same basic configuration, only the image forming unit Uy for yellow will be described below.

In the image forming unit Uy for yellow in FIG. 1, an image bearing member 1*y* is a cylindrical photosensitive member and is rotatably driven at a circumferential speed of 100 mm/second in a direction indicated by an arrow a. A surface of the photosensitive member 1*y* is charged by a charging device. The charging device includes a charging roller 2*y* (charging member) and a charging high-voltage power supply 21. The charging roller 2*y* (charging member) is pressed to contact the surface of the photosensitive member 1*y* and is rotatably driven by the rotation of the photosensitive member 1*y*. Meanwhile, an alternating current (AC) or a direct current (DC) high voltage is applied to the charging roller 2*y* as a charging bias by the charging high-voltage power supply 21. Thus, the surface of the photosensitive member 1*y* is charged to a desired potential.

Then, the photosensitive member 1*y* is exposed to light by an exposure device 3 (latent image forming unit) according to information of an image to be recorded. Exposure is performed by a laser beam scanner.

A one-component non-magnetic contact developing device 4*y* includes a developing roller 41*y* and a supply roller 42*y*. The developing roller 41*y* is a toner bearing member for carrying and conveying a developer (toner) to the surface of the photosensitive member 1*y*. The supply roller 42*y* is a toner supply member for supplying the toner to the surface of the developing roller 41*y*.

The developing roller 41*y*, with its surface uniformly coated by toner, is lightly pressed to contact the photosensitive member 1*y* and rotates at a different speed in the forward direction. While the developing roller 41*y* is rotating, a development high-voltage power supply 43 (voltage application device) applies a predetermined DC voltage to the photosensitive member 1*y* to visualize a latent image formed thereon into a toner image. The supply roller 42*y* for supplying toner to the developing roller 41*y* is in contact with the developing roller 41*y*. According to the present exemplary embodiment, the photosensitive member 1*y* and the developing roller 41*y* can separate from and contact to each other.

As the photosensitive member 1*y* rotates, the toner image on the photosensitive member 1*y* visualized by the developing device 4*y* is conveyed to a primary transfer portion formed between the intermediate transfer belt 5 and the photosensitive member 1*y*. The intermediate transfer belt 5 in contact with the photosensitive member 1*y* is driven in the direction of an arrow b.

A primary transfer roller 8*y* (primary transfer unit) is pressed to contact the photosensitive member 1*y* via the intermediate transfer belt 5. A primary transfer high-voltage power supply 81 applies a voltage to the primary transfer roller 8*y* to form a transfer electric field on the primary transfer portion. When the toner image reached the primary transfer portion, it is transferred onto the surface of the intermediate transfer belt 5 by the action of the transfer electric field.

After primary transfer, the charging state of the photosensitive member 1*y* is unstable by the existence or absence of the toner image or the effect of the primary transfer high voltage. According to the present exemplary embodiment, after primary transfer, an exposure device (not illustrated) using a light emitting diode (LED) irradiates the photosensitive member 1*y* to stabilize the charging state of the photosensitive member 1*y*, and thus the photosensitive member 1*y* can be uniformly charged.

The primary transfer roller 8*y* according to the present exemplary embodiment has a roller shape in which an ethylene propylene diene monomer (EPDM) rubber layer is formed around a cored bar. The EPDM rubber layer is formed by dispersing carbon in rubber to provide a volume resistance value of $10^5\Omega$ or less for conduction and foaming. The primary transfer high-voltage power supply 81 applies a voltage to the cored bar. Although, in the present exemplary embodiment, the primary transfer roller 8*y* is roller-shaped, it may be sheet-, blade-, or brush-shaped.

The intermediate transfer belt 5 provides a volume resistance value of $10^7\Omega$ or less. The intermediate transfer belt 5 may be a single-layer belt made of resin or rubber with dispersed conductive particles for resistance value adjustment, or may have a multi-layered structure which is formed that a resin or rubber belt having a resistance value of $10^4\Omega$ or less is coated with a plurality of layers of fluoroplastics such as polytetrafluoroethylene (PTFE), polyfluoroalkoxy (PFA), and ethylene tetrafluoroethylene (ETFE) of several tens of micrometers for improving the mold release characteristics. The intermediate transfer belt 5 is stretched around and driven by a drive roller 6, a support roller 7, and a secondary transfer counter roller 92 and is configured as an intermediate transfer unit.

Similar to the image forming unit Uy, toner images formed on other image forming units Um, Uc, and Uk are sequentially overlapped on the intermediate transfer belt 5 to form a full-color toner image. In this case, the drive roller 6 and the support roller 7 are electrically floated, or applied a high voltage conforming to the primary transfer high voltage. The secondary transfer counter roller 92 is adjusted to provide a resistance value of $10^6\Omega$ or less, and is grounded.

When the full-color toner image on the intermediate transfer belt 5 reaches a secondary transfer portion formed of the secondary transfer roller 9 (secondary transfer unit) and the intermediate transfer belt 5, a transfer material P is supplied from a sheet feeding unit 10. At the timing when the transfer material P reaches the secondary transfer portion, the secondary transfer high-voltage power supply 91 applies a predetermined high voltage to the secondary transfer roller 9 to transfer the toner image onto the transfer material P therefrom. Similar to the primary transfer roller 8, the secondary transfer roller 9 is formed of a cored bar and of an EPDM rubber layer formed around the cored bar in a roller shape. The volume resistance value of the EPDM rubber layer is adjusted to $10^7$ to $10^{13}\Omega$. Similar to the primary transfer roller 8, the voltage from the secondary transfer high-voltage power supply 91 is applied to the cored bar.

The action of secondary transfer voltage applies a secondary transfer current to a path formed of the secondary transfer roller 9, the transfer material P, the intermediate transfer belt 5, and the secondary transfer counter roller 92 and forms an electric field required for secondary transfer.

The transfer material P having the full-color toner image transferred thereon is detached from the intermediate transfer belt 5 by the curvature of the secondary transfer counter roller 92, and then conveyed to a fixing device 11 in a state where the toner image is put on the transfer material P. The fixing device 11 applies heat and pressure to the transfer material P to fix the toner image thereon. The fixing device 11 includes a fixing sleeve 111 and a pressure roller 112.

Meanwhile, residual toner after completion of primary transfer is cleaned by a photosensitive member cleaner 12*y*, and residual toner on the intermediate transfer member after secondary transfer is removed by a cleaning device 13. The cleaning device 13 includes a cleaning blade 131 and a waste toner container 132.

Figure 2:
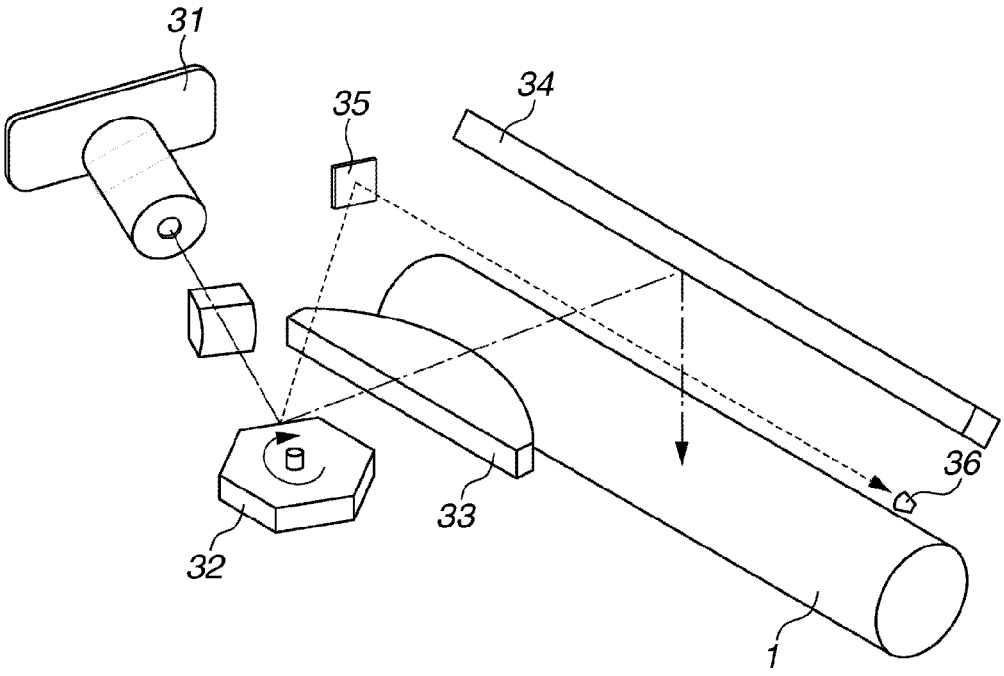
FIG. 2 illustrates an example of an exposure device.

FIG. 2 illustrates a configuration of the exposure device provided in the image forming apparatus. Collimated light obtained from a laser unit 31 is reflectively deflected by a rotating polygon mirror 32, passes through an fθ lens 33 and a folding mirror 34, and eventually reaches the surface of a photosensitive drum 1. A part of the scanning beam is reflected by a beam detection (BD) mirror 35 and then optically detected by a BD sensor 36. Apart of the scanning beam is also used to synchronize a write signal for each scanning based on an output signal from the BD sensor 36, adjust a beam write position (exposure start position) so as not to shift, and control the rotation of a scanner motor (described below).

The laser unit 31 includes a semiconductor laser device, a collimator lens adhesively fixed to a collimator lens barrel, and a laser driving substrate for supplying a current required for semiconductor laser beam emission and performing emission ON/OFF control. The semiconductor laser device includes an edge emitting laser chip and a photo diode.

Figure 3:
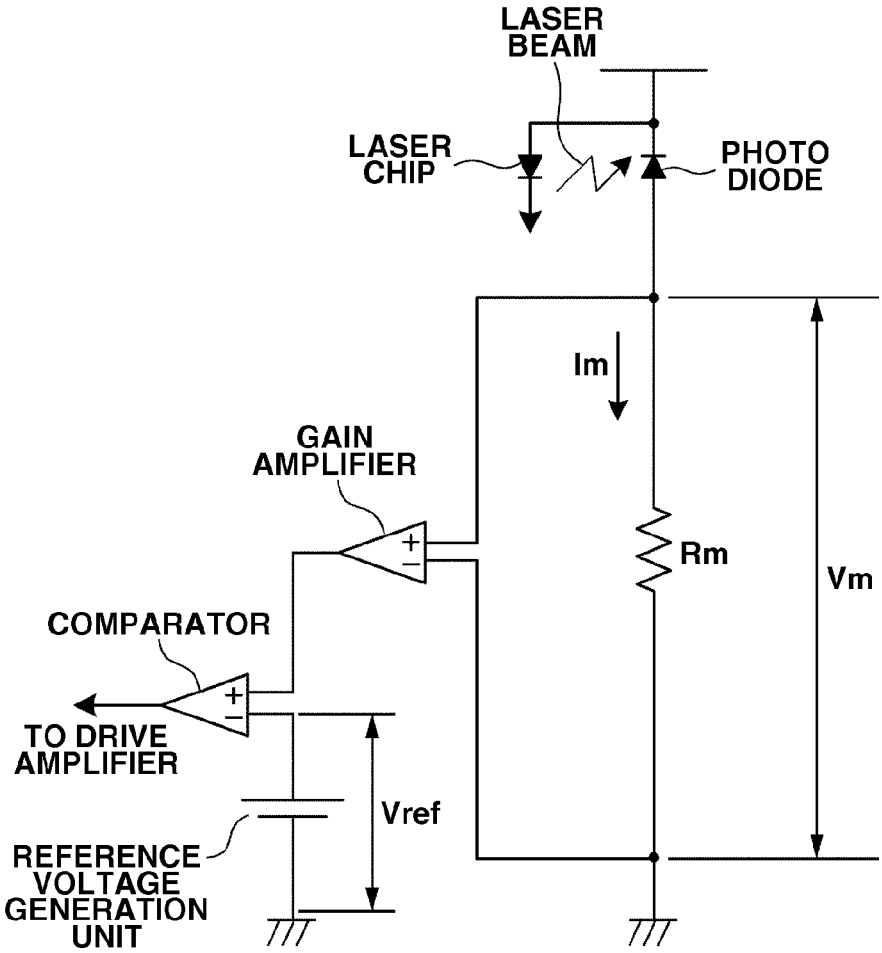
FIG. 3 illustrates an automatic power control (APC) circuit.

FIG. 3 illustrates an APC circuit for controlling the semiconductor laser beam amount to a constant value. The APC circuit receives the laser beam emitted from the laser chip by the photo diode and applies photoelectric conversion to the laser beam to produce a monitor current Im. The monitor current Im is converted into a monitor voltage Vm by a resistance Rm. The monitor voltage Vm is amplified by a gain amplifier and then input to a comparator which compares the monitor voltage Vm with a reference voltage Vref of a reference voltage generation unit. The current applied to the laser chip is subjected to feedback control so that the monitor voltage Vm amplified by the gain amplifier coincides with the reference voltage Vref. A relation among the monitor voltage Vm, the resistance Rm, and the monitor current Im is indicated as follows.

$$Im = Vm/Rm \tag{1}$$

The resistance Rm is adjusted so that the laser beam amount becomes a predetermined value on the photosensitive drum 1.

Figure 4A:
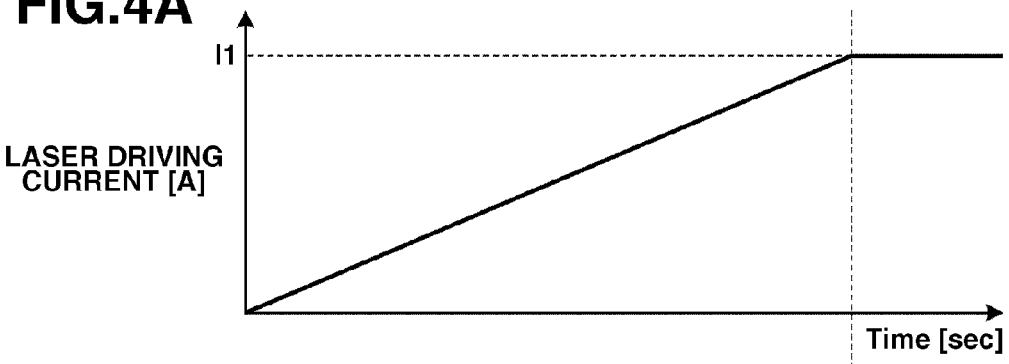
FIGS. 4A to 4C illustrate a relation among a laser driving current, a laser beam amount, and a photosensitive drum potential during an APC operation.
Figure 4B:
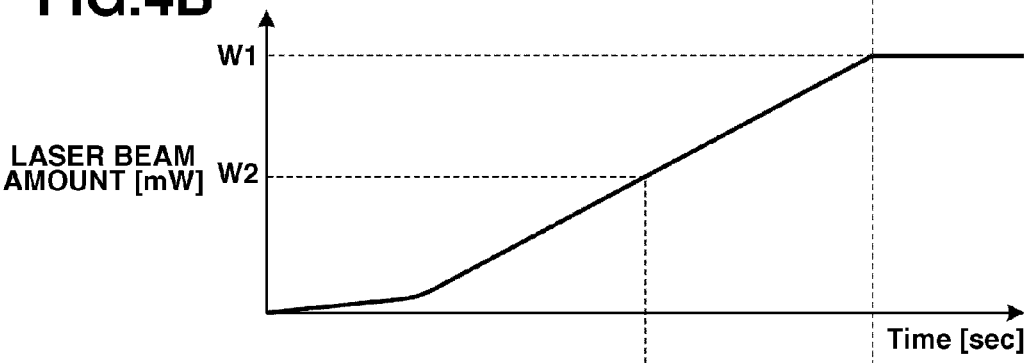
Figure 4C:
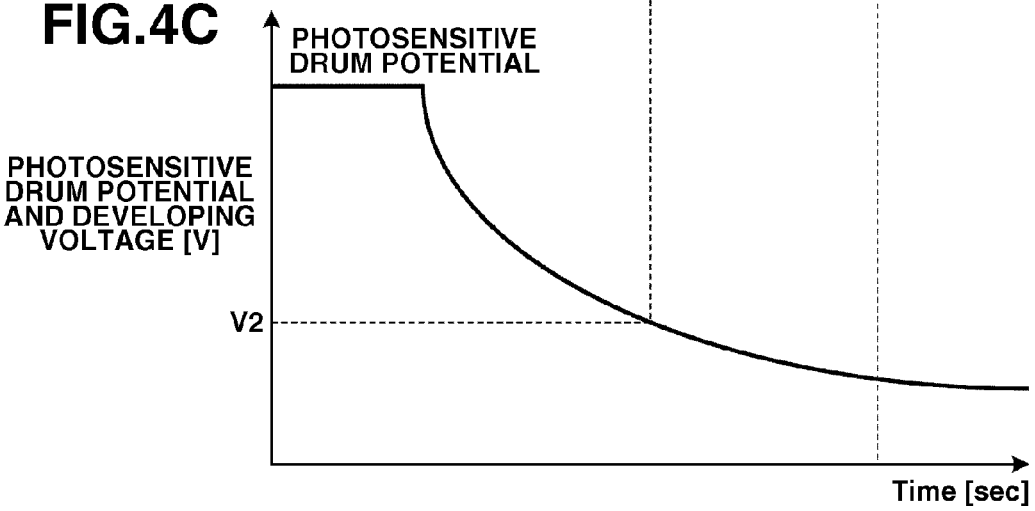
Figure 5:
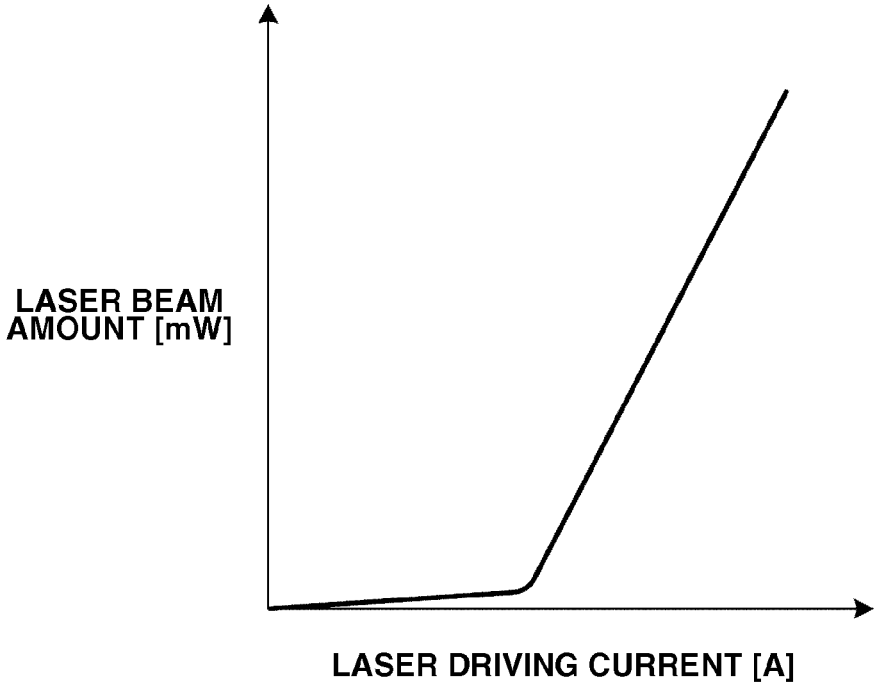
FIG. 5 illustrates current-output characteristics of laser.
Figure 6:
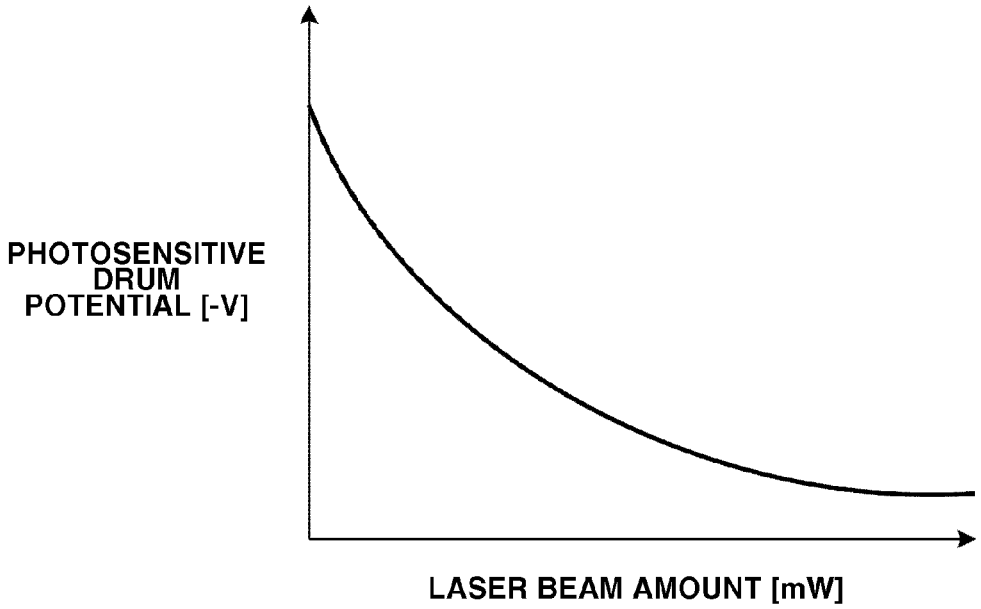
FIG. 6 illustrates a relation between a laser beam amount and a photosensitive drum potential.

The APC operation will be described in more detail below. During the APC operation, a laser driving current value is gradually increased as illustrated in a graph in FIG. 4A. Accordingly, the laser beam amount is increased as illustrated in a graph in FIG. 4B according to a current-output characteristics illustrated in FIG. 5. When the laser beam amount reaches a preset target value W1 [mW], the CPU 14 fixes the laser driving current value to the relevant value I1 [A], and terminates the APC operation. During the APC operation, the photosensitive drum potential varies as illustrated in a graph in FIG. 4C according to the laser beam amount-photosensitive drum potential characteristics illustrated in FIG. 6.

Figure 7:
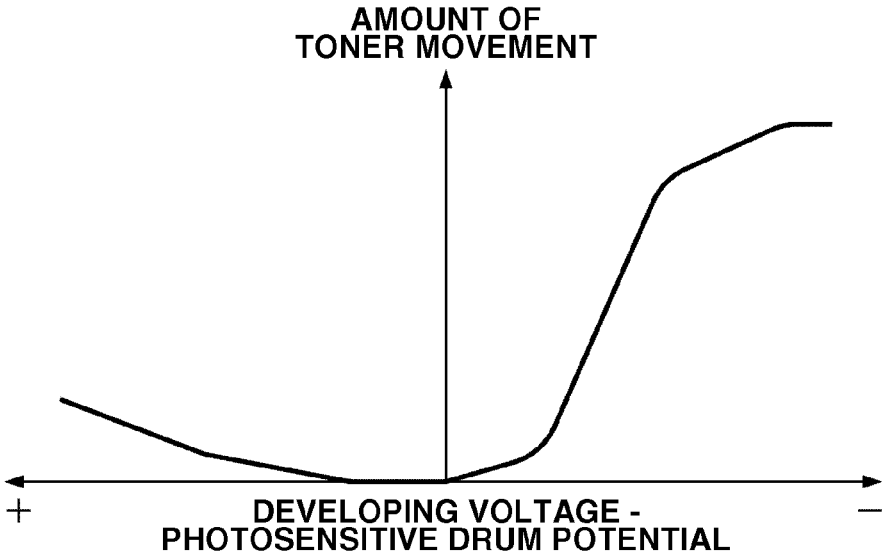
FIG. 7 illustrates a relation between a potential difference between a developing voltage and a photosensitive drum, and an amount of toner movement.

A relation between a potential difference between the developing voltage and the photosensitive drum potential, and an amount of toner movement will be described below. FIG. 7 illustrates the relation between the potential difference between the photosensitive drum potential and the developing voltage, and the amount of toner movement when negatively charged toner is used. When a potential difference acquired by subtracting the photosensitive drum potential from the developing voltage has the same polarity as the toner polarity, toner on the developing roller is developed onto the photosensitive drum. Otherwise, when the potential difference acquired by subtracting the photosensitive drum potential from the developing voltage has the opposite polarity of the toner polarity, toner on the developing roller is not developed onto the photosensitive drum.

However, toner includes inverted toner, i.e., toner charged to the opposite polarity of the normal charging polarity. (The normal charging polarity refers to the charging polarity for developing an electrostatic latent image. According to the present exemplary embodiment, the normal toner charging polarity is the negative polarity since a negatively charged electrostatic latent image is invertedly developed.) The inverted toner may move from the developing roller to the photosensitive drum (hereinafter, this phenomenon is referred to as inverted fogging). When the potential difference acquired by subtracting the photosensitive drum potential from the developing voltage has the opposite polarity of the toner polarity, and the potential difference has the larger absolute value, the inverted fogging is more significant.

Therefore, to prevent toner from moving to the photosensitive drum, it is desirable to set the potential difference acquired by subtracting the photosensitive drum potential from the developing voltage to the opposite polarity of the toner polarity, and to reduce the absolute value thereof to a level at which inverted fogging does not occur.

As described above, an electrostatic latent image is formed on the photosensitive drum during the APC operation (in an adjustment period during which the laser beam output is adjusted while exposing the photosensitive drum to light prior to image formation). Therefore, if the developing roller contacts the photosensitive drum during the APC operation, toner may be transferred onto the photosensitive drum. To cope with this issue, conventionally, the developing roller is brought into contact with the photosensitive drum after completion of the APC and extinction of the laser as illustrated by a line A in FIG. 8, thus preventing wasteful toner consumption. With this method, however, the time period till completion of image formation setup is prolonged which results in an increase in FPOT, as illustrated by the line A in FIG. 8.

To shorten FPOT, it is desirable to perform control for bringing the developing roller into contact with the photosensitive drum in advance before completion of the APC.

Figure 8:
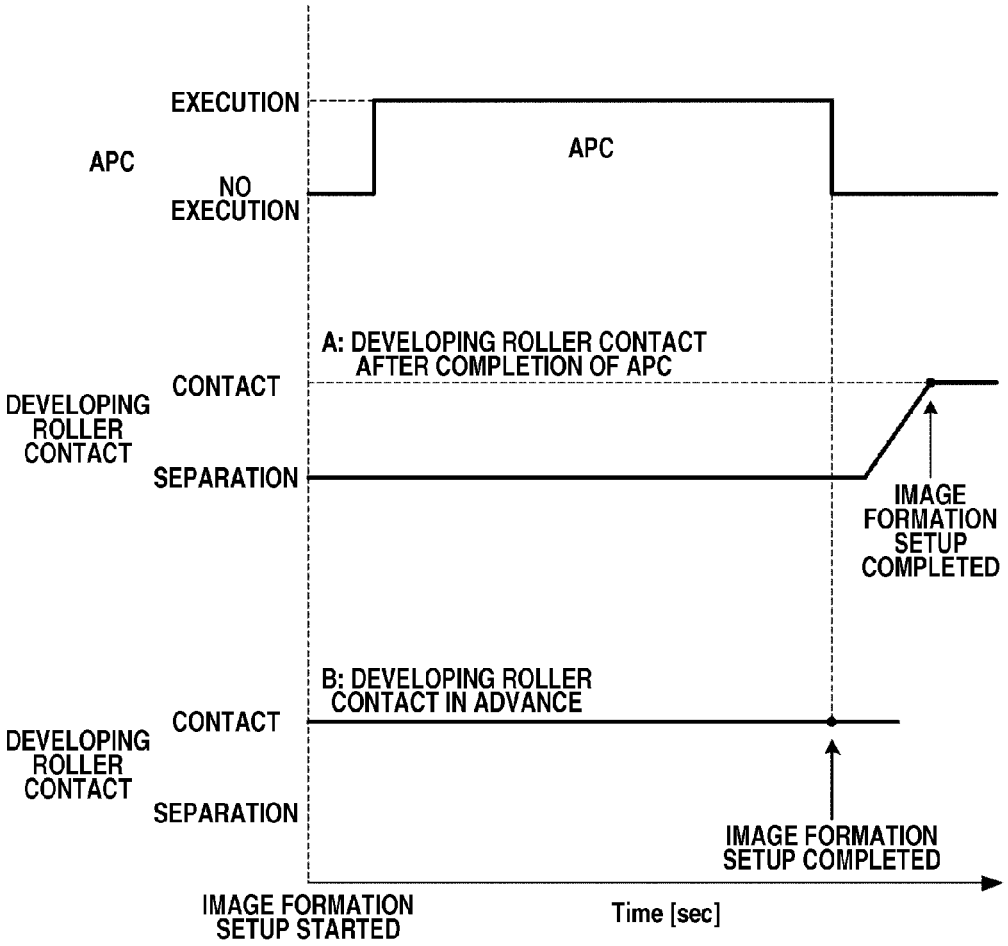
FIG. 8 illustrates a relation among a photosensitive drum potential, a developing voltage, and a developing roller contact timing.

For reference, control for bringing the developing roller into contact with the photosensitive drum in advance before starting the APC will be described below with reference to a line B in FIG. 8. First, the CPU 14 acquires in advance a laser beam amount W2 [mW] with which the photosensitive drum potential becomes a predetermined voltage V2. Then, based on the result of laser beam amount monitoring performed during the APC operation, the CPU 14 acquires a timing when a predetermined laser beam amount W2 [mW] is reached.

Figure 9:
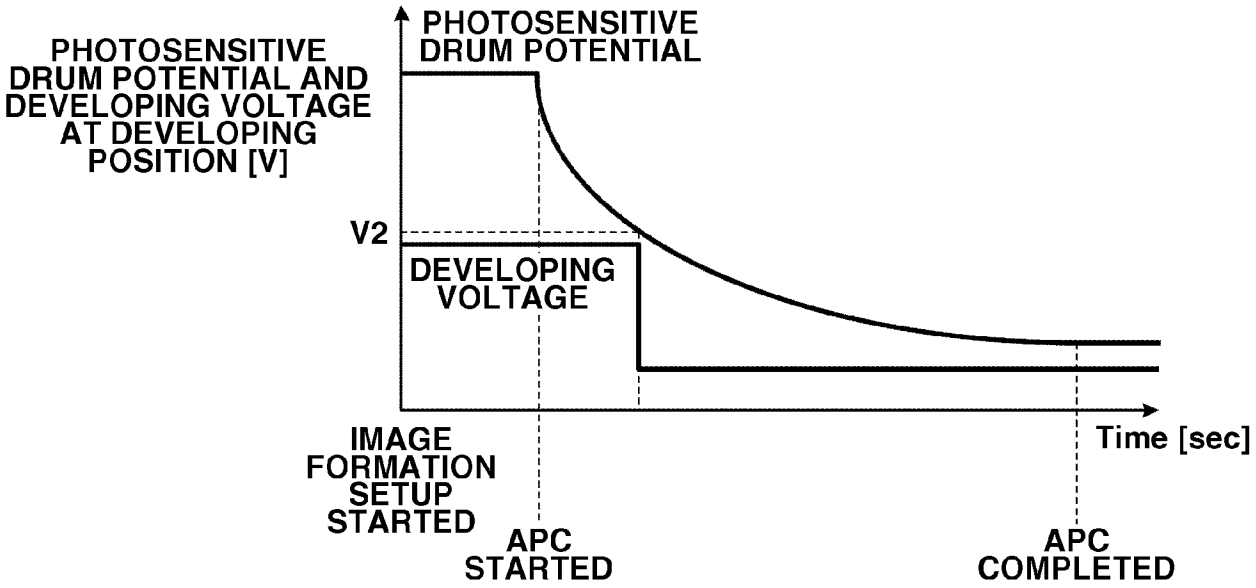
FIG. 9 illustrates a relation between a photosensitive drum potential and a developing voltage.

At a timing when a portion on the photosensitive drum irradiated with the laser beam amount W2 [mW], i.e., a portion where the photosensitive drum potential becomes the predetermined voltage V2, reaches a developing position, the CPU 14 changes the developing voltage to a second developing voltage as illustrated in FIG. 9. There is a time difference between the timing when the predetermined laser beam amount W2 [mW] is reached and the timing when the developing voltage is changed to the second developing voltage according to a distance between the laser irradiation position and the developing roller contact position. This configuration sets the potential difference between the developing voltage and the photosensitive drum potential to the opposite polarity of toner charging polarity, and thus toner development is restrained.

However, the photosensitive drum sensitivity generally varies according to a manufacturing tolerance, a usage environment, and a degree of degradation. More specifically, irradiation of the photosensitive drum with an identical laser beam amount does not necessarily cause an identical photosensitive drum potential illustrated by a solid line a in FIG. 10 but causes variations in photosensitive drum potential as illustrated by broken lines b and c in FIG. 10.

Figure 10:
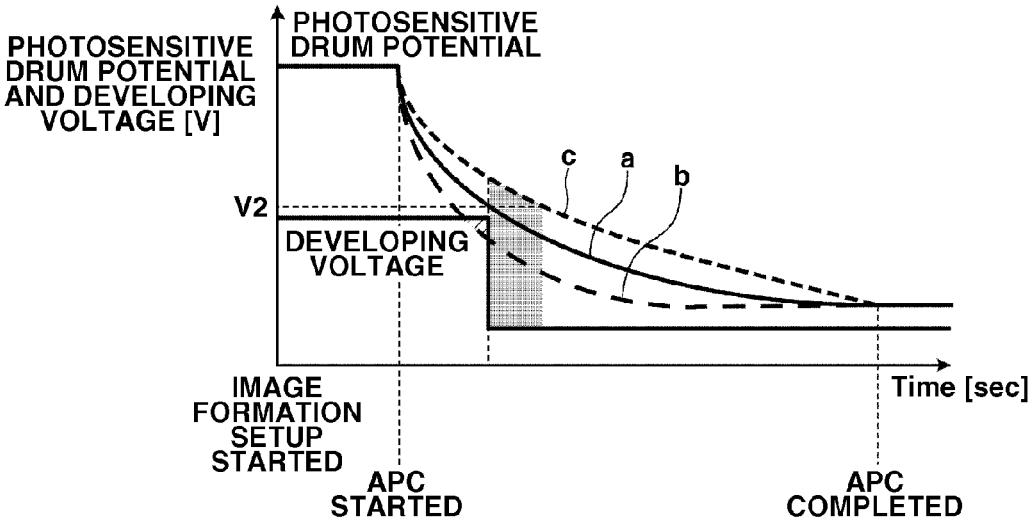
FIG. 10 illustrates a state in which fogging occurs.

Referring to FIG. 10, in the case of the curve b which indicates that the photosensitive drum sensitivity is higher than the curve a, i.e., the photosensitive drum potential is likely to decrease, an area as indicated by diagonal lines in FIG. 10 is produced, where the potential difference acquired by subtracting the photosensitive drum potential from the developing voltage has the same polarity as the toner polarity, resulting in toner development. Conversely, in the case of the curve c which indicates that the photosensitive drum sensitivity is lower than the curve a, i.e., the photosensitive drum potential is not likely to decrease, an area as indicated by a shaded portion in FIG. 10 is produced. In this area, since the potential difference acquired by subtracting the photosensitive drum potential from the developing voltage has the opposite polarity of the toner polarity and a large absolute value, inverted fogging occurs.

Thus, when the developing roller is constantly in contact with the photosensitive drum before starting the APC, it is necessary to synchronize the voltage to be applied to the developing roller with the photosensitive drum surface potential to prevent toner on the developing roller from moving to the photosensitive drum. However, during pre-rotation, the laser beam amount control (APC) and scanner motor control are performed and therefore the photosensitive drum surface potential largely varies. Accordingly, when taking variation in the photosensitive drum into consideration, it is difficult to restrict the potential difference within a desired range. As a result, there arises an issue that wasteful toner consumption and stain on the rear surface of paper are highly likely to occur.

Figure 11:
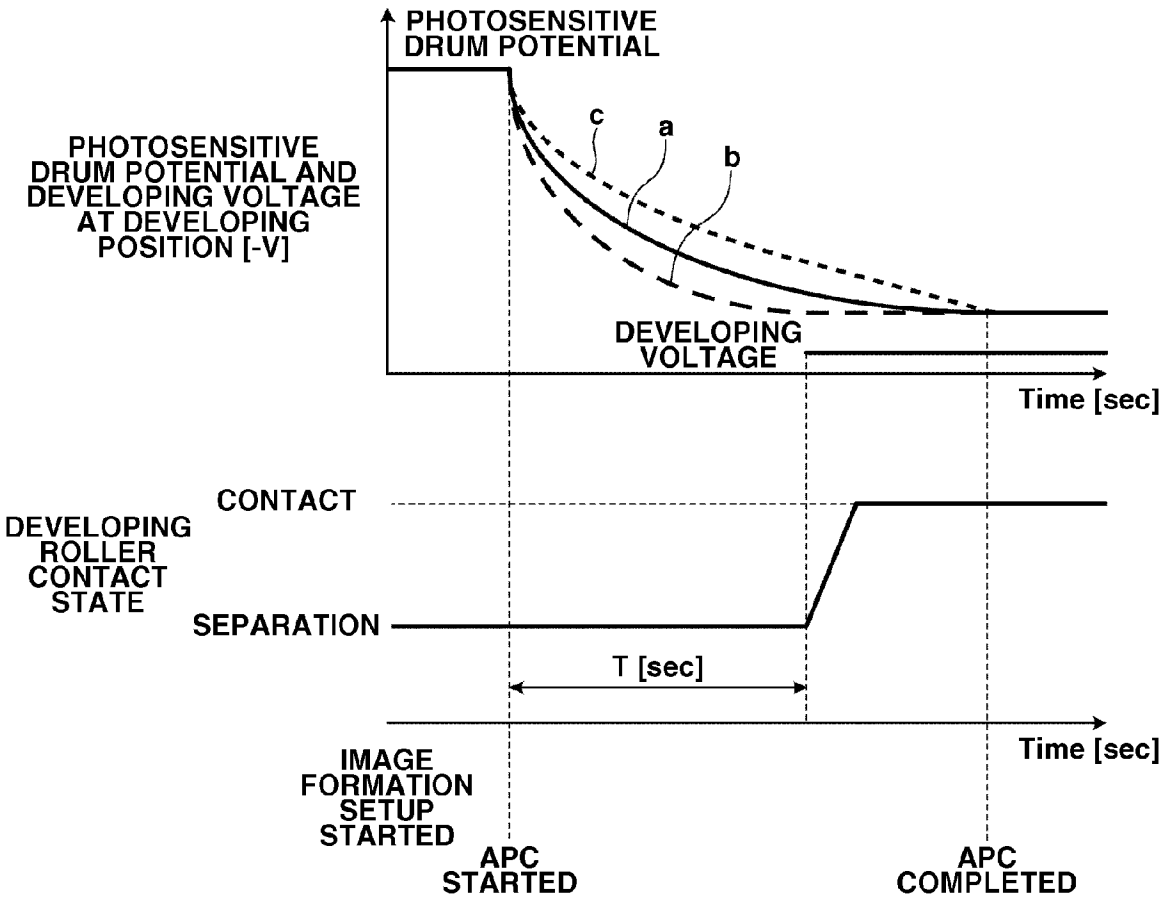
FIG. 11 illustrates a relation among a photosensitive drum potential, a developing voltage, and a developing roller contact timing.

Thus, according to the present exemplary embodiment, the developing roller is separated from the photosensitive drum (i.e., a separation state) at the start of the APC, and when a predetermined time T [second] has elapsed since the laser driving current is applied (i.e., since a time period during which the laser beam output is adjusted is started), the developing roller is brought into contact with the photosensitive drum (i.e., shift to a contact state) as illustrated in FIG. 11. In addition, the CPU 14 performs control to change the developing voltage at that time to the second developing voltage with which toner is not transferred from the developing roller to the photosensitive drum. Taking the variation in the photosensitive drum sensitivity into consideration, the predetermined time T is set so that the potential difference between the photosensitive drum potential and the second developing voltage (potential of the developing roller 41*y*) decreases to a level at which inverted fogging does not occur.

The developing voltage when the developing roller is in the contact state is set as the second developing voltage with which toner is not developed. Therefore, even if the photosensitive drum sensitivity varies, the potential difference between the developing voltage and the photosensitive drum potential constantly has the opposite polarity of the toner polarity. Thus, toner is not developed during the APC. Since the developing roller is brought into contact with the photosensitive drum not before starting the APC but after a predetermined time T [second] has elapsed since the APC is started, the potential difference between the photosensitive drum potential and the developing voltage does not unnecessarily increase, and occurrence of the inverted fogging can be prevented. Thus, wasteful toner consumption and stain on the rear surface of paper can be prevented. In addition, the configuration according to the present exemplary embodiment enables the developing roller to contact the photosensitive drum before the APC operation ends, and FPOT can be reduced. Further, the configuration also makes it easier to control the potential difference between the developing roller potential and the photosensitive drum potential to prevent fogging than a case where the developing roller is in contact with the photosensitive drum in advance before starting the APC.

The configuration according to the present exemplary embodiment will be described in detail below. Only the image forming unit Uy for yellow will be described below.

When the image forming apparatus receives a print signal, the photosensitive drum 1*y* starts rotating. As described above, a charging bias is applied to the photosensitive drum 1*y* to charge it to a predetermined charging potential. According to the present exemplary embodiment, the charging potential is set to about −500 V, and a −1000 V voltage is applied to the charging roller 2*y* as a charging bias. Then, the above-described APC is executed to acquire a suitable laser beam amount. According to the present exemplary embodiment, the laser beam amount is adjusted so that the exposed portion potential becomes −150 V.

When a predetermined time T [second] has elapsed from since the APC is started, the developing roller 41*y* is brought into contact with the photosensitive drum 1*y*. In the predetermined time T including a timing when the developing roller 41*y* and the photosensitive drum 1*y* are changed from the separation state to the contact state, the CPU 14 applies the second developing voltage to the developing roller 41*y*, with which toner is not developed. According to the present exemplary embodiment, the second developing voltage is set to −50 V. With these settings, a value acquired by subtracting the photosensitive drum potential from the developing voltage will be +100 V, a positive value having the opposite polarity of the normal toner charging polarity. Therefore, toner is not transferred onto the photosensitive drum during execution of the APC. According to the present exemplary embodiment, since the developing voltage at the time of image formation is −350 V, a potential difference acquired by subtracting the voltage at the time of image formation from the second developing voltage has the positive polarity.

The predetermined time T [second] is determined in consideration of the variation in the photosensitive drum sensitivity. Since the second developing voltage is set to have the same polarity as the normal toner charging polarity, the processing can restrict transfer of the inverted toner to the photosensitive drum (inverted fogging) to further extent than when the developing voltage is turned off. According to the present exemplary embodiment, particularly when a low-sensitivity photosensitive drum is used, the potential difference between the photosensitive drum and the developing roller in the developing roller contact state is set to a value having an absolute value smaller than −150 V (close to 0 V). According to consideration by the inventors of the present invention, inverted fogging can be more effectively prevented from occurring by setting the potential difference between the photosensitive drum and the developing roller to a value having an absolute value smaller than −150 V. Therefore, even when a low-sensitivity photosensitive drum is used, the potential difference between the photosensitive drum and the developing roller will be a value smaller than −150 V, and inverted fogging does not occur.

As described above, bringing the developing roller into contact with the photosensitive drum during execution of the APC makes it possible not only to prevent toner development and inverted fogging but also to shorten FPOT in an easy way. More specifically, the present exemplary embodiment can fulfill both of the prevention of wasteful toner consumption and stain on the rear surface of paper and shortening of FPOT in an easy way.

The present exemplary embodiment is also effective when optical adjustment other than the APC is performed by emitting a laser at the start of image formation. For example, there is a case where synchronization adjustment of the laser write position is performed by detecting apart of the scanning beam via the BD sensor 36 simultaneously with the start of the polygon mirror rotation. In this case, since the laser beam needs to be emitted until the polygon mirror rotation reaches a steady state, a similar issue to that in the APC execution arises. Even in this case, the configuration according to the present exemplary embodiment is effective for FPOT reduction. When the polygon mirror rotation reaches a steady state and subsequently, since the laser is not emitted in the development area (an area corresponding to the width of the developing roller) at the time of non-image formation in the regular operation excluding the APC execution, toner adhesion to the photosensitive drum does not occur.

Although, in the present exemplary embodiment, only the image forming unit Uy for yellow is described, similar control to the present exemplary embodiment may also be applied to the image forming units Um, Uc, and Uk for magenta, cyan, and black, respectively. Further, similar control to the present exemplary embodiment may be applied only to the image forming units arranged on the upstream side which are important for FPOT reduction.

Although, in the present exemplary embodiment, a state where the developing roller contacts the photosensitive drum is referred to as "contact state", the "contact state" includes two different states, namely a state where the developing roller directly contacts the photosensitive drum 1*y*, and a state where the developing roller does not directly contact the photosensitive drum but developer carried by the developing roller contacts the photosensitive drum. The term "contact state" is used in a similar way also in the following exemplary embodiments.

A second exemplary embodiment will be described below based on a case where the use of the image forming units Uy, Um, Uc, and Uk has increased in the basic configuration according to the first exemplary embodiment. Only the image forming unit Uy for yellow will be described below.

Figure 12:
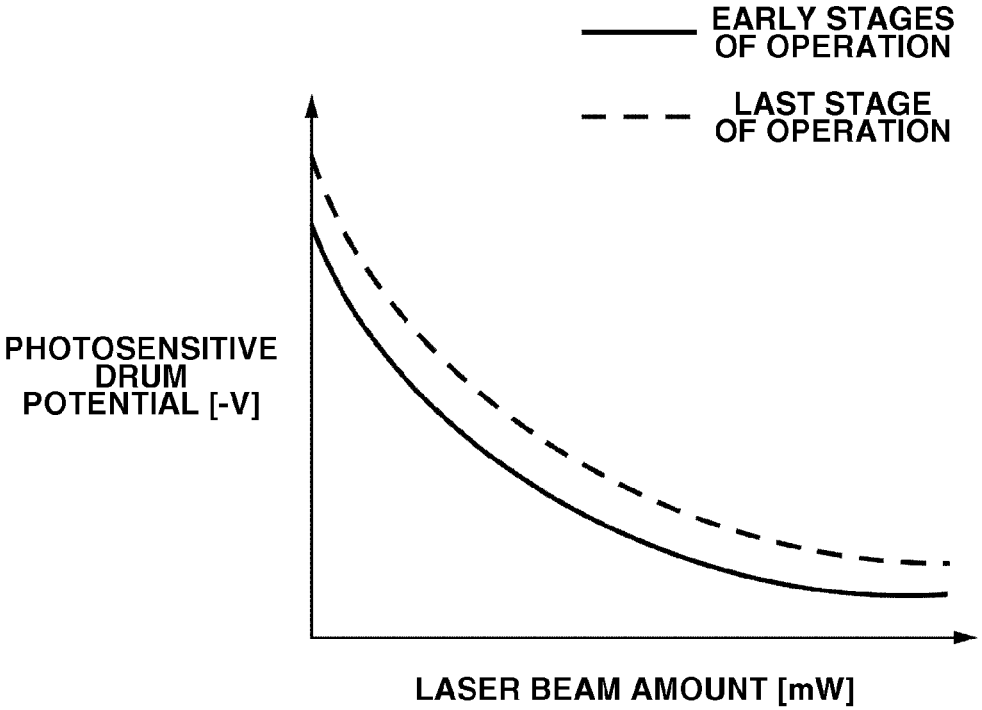
FIG. 12 is a relation between a laser beam amount and a photosensitive drum potential on the early and last stages of operation of an image forming unit.

The present exemplary embodiment will be described below based on a case where a degree of use of the photosensitive drum 1*y* has increased. As the degree of use of the image forming unit Uy increases, the surface of the photosensitive drum 1*y* is naturally scraped and the film thickness on the photosensitive drum 1*y* decreases. Accordingly, the capacitance of the photosensitive drum 1*y* increases and, when a constant charging bias is applied, the charging potential of the photosensitive drum 1*y* increases. As a result, a relation between the laser beam amount and the photosensitive drum potential (see FIG. 6) also changes. As illustrated in FIG. 12, the relation is largely different between the early and last stages of operation of the image forming unit Uy. This phenomenon is also applied to the APC operation.

Therefore, if the second developing voltage to be applied when bringing the developing roller 41*y* into contact with the photosensitive drum 1*y* is constant, after the degree of use of the photosensitive drum 1*y* has increased, the potential difference between the photosensitive drum potential and the developing voltage increases, and inverted fogging occurs. The result is wasteful toner consumption and stain on the rear surface of paper.

According to the present exemplary embodiment, the second developing voltage is corrected according to variation in the film thickness on the photosensitive drum 1*y* so as to prevent an increase in the potential difference between the photosensitive drum potential and the developing voltage even after the degree of use of the photosensitive drum 1*y* has increased. More specifically, the second developing voltage is corrected to increase with the reduction in the film thickness on the photosensitive drum so as to maintain approximately constant the potential difference between the photosensitive drum potential and the developing voltage in the developing roller contact state even after the degree of use of the photosensitive drum has increased.

The control will be described in detail below. According to the present exemplary embodiment, each time printing is performed, the CPU 14 stores in a storage device 15 provided in the image forming apparatus the number of sheets used for printing by respective image forming units. The CPU 14 controls the second developing voltage based on the information about the usage of the image forming units. According to consideration by the inventors of the present invention, each time 4,000 sheets were printed, the film thickness on the photosensitive drum 1*y* decreased by 1 μm, and the absolute value of the charging potential of the photosensitive drum 1*y* increased by 10 V. Accordingly, the absolute value of the exposed portion potential on the photosensitive drum 1*y* also increased by 10 V.

According to the present exemplary embodiment, each time 4,000 sheets are printed, the CPU 14 increases by 10 V the absolute value of the second developing voltage to be applied when the developing roller 41*y* contacts the photosensitive drum 1*y*. Taking into consideration the variation in the photosensitive drum sensitivity similar to the first exemplary embodiment, the configuration of the present exemplary embodiment can set to 150 V or less the potential difference acquired by subtracting the photosensitive drum potential from the developing voltage in the developing roller contact state, even if the film thickness on the photosensitive drum 1*y* decreases. As a result, if the developing roller 41*y* contacts the photosensitive drum 1*y* during execution of the APC, neither toner development nor inverted fogging occurs. Thus, FPOT can be shortened without wasteful toner consumption and stain on the rear surface of paper.

Although, in the present exemplary embodiment, the second developing voltage is changed based on the number of sheets used for printing (number of sheets used for image formation) by the image forming unit, the second developing voltage may be changed based on the rotation number of the photosensitive drum 1*y* and the time period during which a charging bias is applied to the charging roller 2*y* as information about the degree of use of the photosensitive drum 1*y*.

Although, in the present exemplary embodiment, only the image forming unit Uy for yellow is described, similar control to the present exemplary embodiment may also be applied to the image forming units Um, Uc, and Uk for magenta, cyan, and black, respectively, according to the usage status of each photosensitive drum. Further, similar control to the present exemplary embodiment may be applied only to the image forming units arranged on the upstream side which are important for FPOT reduction.

A third exemplary embodiment will be described below based on a case where the usage environment of the image forming apparatus has changed in the basic configuration of the first exemplary embodiment. Only the image forming unit Uy for yellow will be described below.

Figure 13:
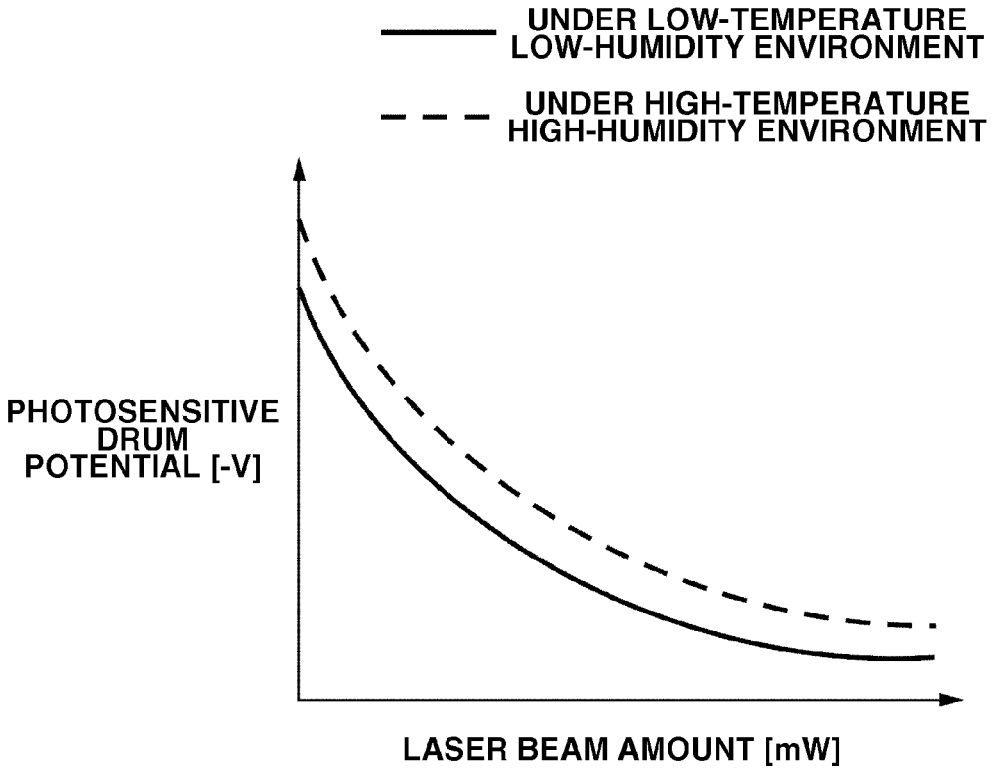
FIG. 13 illustrates a relation between a laser beam amount and a photosensitive drum potential in different usage environments.

When the usage environment has changed, the member resistance also changes and therefore the charging characteristics of the photosensitive drum 1*y* change. Under a high-temperature and high-humidity environment, i.e., in an environment containing high absolute moisture content in air, the member resistance decreases, and accordingly the charging potential of the photosensitive drum 1*y* increases when a constant charging bias is applied to the photosensitive drum 1*y*. On the contrary, under a low-temperature and low-humidity environment, i.e., in an environment containing low absolute moisture content in air, the member resistance increases, and accordingly the charging potential of the photosensitive drum 1*y* decreases. As a result, the exposed portion potential on the photosensitive drum 1*y* also changes depending on the usage environment. Under the high-temperature and high-humidity environment, the exposed portion potential on the photosensitive drum 1*y* increases. Under the low-temperature and low-humidity environment, the exposed portion potential on the photosensitive drum 1*y* decreases. As a result, the relation between the laser beam amount and the photosensitive drum potential (see FIG. 6) also changes. As illustrated in FIG. 13, the relation largely depends on the usage environment. This phenomenon is also applied to the APC operation.

Therefore, if the second developing voltage applied when bringing the developing roller 41*y* into contact with the photosensitive drum 1*y* is constant, under the high-temperature and high-humidity environment, the potential difference between the photosensitive drum potential and the developing voltage increases, and inverted fogging may occur. Under the low-temperature and low-humidity environment, the potential difference between the photosensitive drum potential and the developing voltage decreases, and there is a fear of causing toner development. The result is wasteful toner consumption and stain on the rear surface of paper.

According to the present exemplary embodiment, therefore, the second developing voltage is changed according to the detection result in the usage environment so as to prevent variation in the potential difference between the photosensitive drum potential and the developing voltage even when the charging characteristics of the photosensitive drum 1*y* change according to the usage environment. More specifically, under the high-temperature and high-humidity environment in which the exposed portion potential increases, the CPU 14 performs correction to increase the second developing voltage. Under the low-temperature and low-humidity environment in which the exposed portion potential decreases, the CPU 14 performs correction to decrease the second developing voltage. With this configuration, control is performed to maintain an approximately constant value of the potential difference between the photosensitive drum potential and developing voltage in the developing roller 41 contact state regardless of the usage environment.

The control will be described in detail below. According to the present exemplary embodiment, an environmental detection device 16 detects the usage environment. According to consideration by the inventors of the present invention, the charging potential and exposed portion potential on the photosensitive drum 1*y* when a −1000 V charging bias was applied to the charging roller 2*y* in each usage environment were as shown in Table 1.

TABLE 1

| | Charging potential | exposed portion potential | second developing voltage | developing voltage-photosensitive drum potential in developing roller contact state |
|---|---|---|---|---|
| low-temperature low-humidity environment | −470 V | −120 V | −20 V | +100 V |
| normal-temperature normal-humidity environment | −500 V | −150 V | −50 V | +100 V |
| high-temperature high-humidity environment | −530 V | −180 V | −80 V | +100 V |

According to the present exemplary embodiment, the second developing voltage is changed for each usage environment, as shown in Table 1. Setting the second developing voltage in this way enables setting to −100 V the potential difference between the potential of the photosensitive drum 1*y* and the developing voltage when the developing roller 41*y* contacts the photosensitive drum 1*y* regardless of the usage environment. Therefore, if the developing roller 41*y* contacts the photosensitive drum 1*y* during execution of the APC, neither toner development nor inverted fogging occurs. Thus, FPOT can be shortened without wasteful toner consumption and stain on the rear surface of paper.

Although, in the present exemplary embodiment, only the image forming unit Uy for yellow is described, similar control to the present exemplary embodiment may also be applied to the image forming units Um, Uc, and Uk for magenta, cyan, and black, respectively. Further, similar control to the present exemplary embodiment may be applied only to the image forming units arranged on the upstream side which are important for FPOT reduction.

According to the first to third exemplary embodiments, by bringing the developing rollers 41 into contact with the photosensitive members 1 exposed in the APC, both of the prevention of wasteful toner consumption and stain on the rear surface of paper and shortening of FPOT can be fulfilled in an easy way. In this case, the developing bias during pre-rotation is controlled to prevent wasteful toner consumption and stain on the rear surface of paper. In a fourth exemplary embodiment, toner movement to the photosensitive drum in the developing roller contact state is prevented by differentiating the voltage to be applied to the charging roller during the pre-rotation from the voltage at the time of image formation.

The configuration according to the present exemplary embodiment will be described below. For similar configurations and operations to the first to third exemplary embodiments, redundant description thereof will be avoided.

Figure 14A:
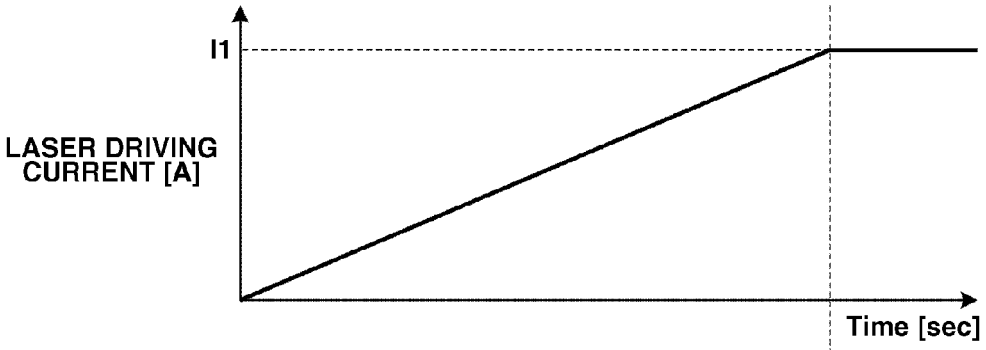
FIGS. 14A and 14B illustrate a relation between a laser driving current and a laser beam amount during an APC operation.
Figure 14B:
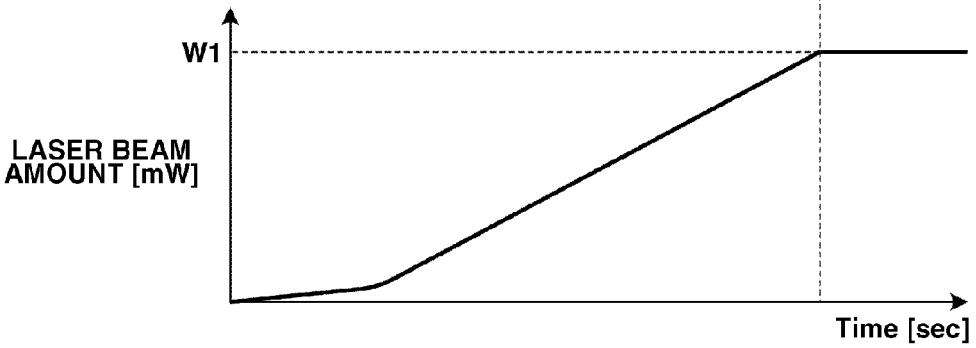
Figure 15:
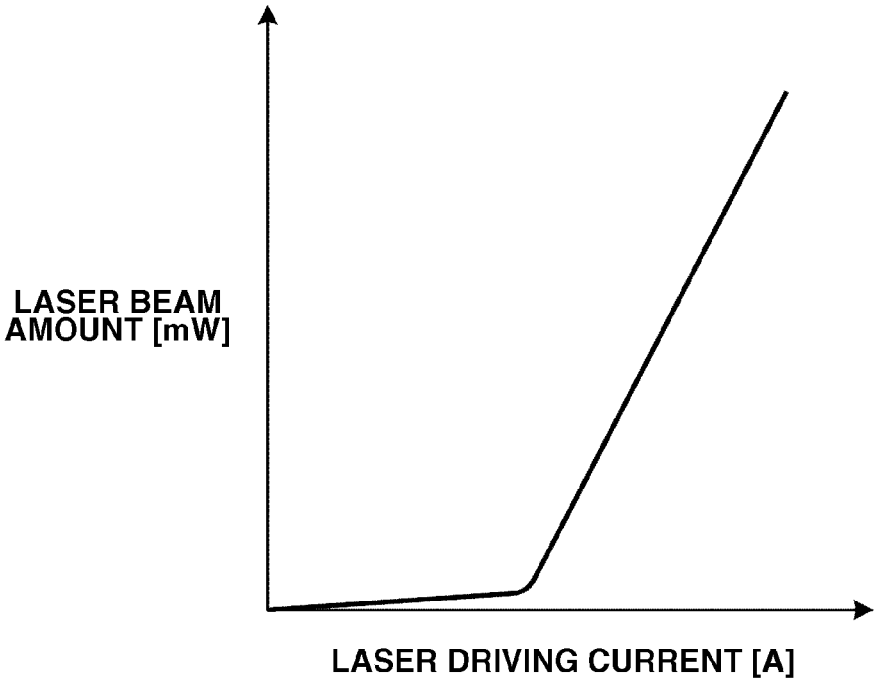
FIG. 15 illustrates current-output characteristics of laser.

In the APC operation according to the present exemplary embodiment, the CPU 14 gradually increases the laser driving current value as illustrated in a graph in FIG. 14A. In this case, the laser beam amount increases as illustrated in a graph in FIG. 14B according to the current-output characteristics illustrated in FIG. 15. When the laser beam amount reaches a preset target value W1 [mW], the CPU 14 fixes the laser driving current value to the relevant value I1 [A], and terminates the APC operation.

Figure 16:
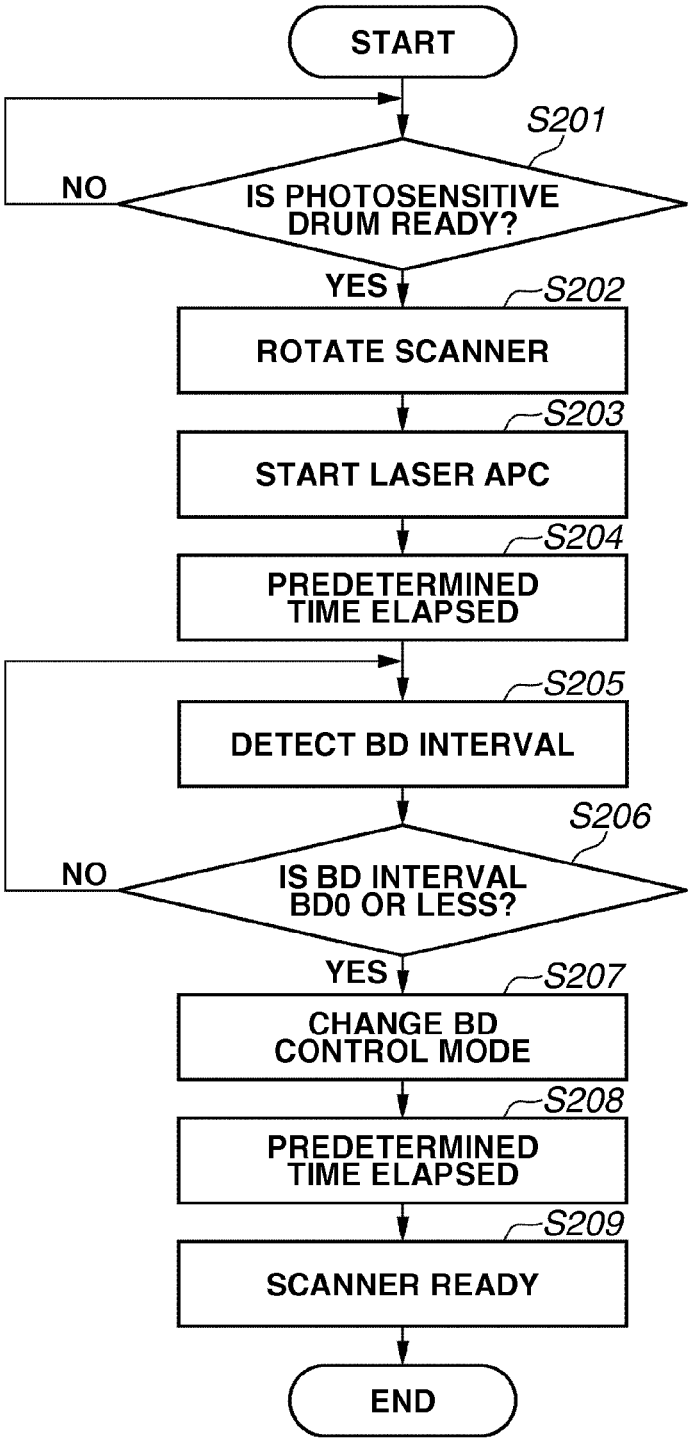
FIG. 16 is a flowchart illustrating a processing flow until the exposure device is ready to operate.

Operations performed since the image forming apparatus receives a print instruction until the exposure device completes image formation setup will be described below with reference to the flowchart in FIG. 16. In step S201, the CPU 14 determines whether the photosensitive drum is rotating.

Since the photosensitive drum is regularly rotated by a DC motor and a stepping motor, the CPU 14 makes the determination according to whether the rotation numbers of these motors are predetermined rotation numbers or by using a hardware-based ready signal. When the CPU 14 determines that the photosensitive drum is in a ready state (YES in step S201), then in step S202, the CPU 14 instructs the scanner motor to start operation.

In step S203, the CPU 14 causes the laser unit to continuously emit the laser and starts the above-described APC. In step S204, the CPU 14 waits until a predetermined time has elapsed. In step S205, when the predetermined time has elapsed, the CPU 14 detects a BD interval, for example, by measuring a time period since the BD signal is detected until the following BD signal is detected with a timer.

In step S206, the CPU 14 determines whether the detected BD interval is equal to or less than a predetermined interval BD0. When the detected BD is equal to or less than the BD0 (YES in step S206), the processing proceeds to step S207. Otherwise (NO in step S206), the processing returns to step S205. The predetermined interval BD0 is about −5% of the BD interval at the time of steady rotation of the scanner motor, and is recognized as an interval with which the scanner motor rotation is close to a specified rotation number.

In step S207, the CPU 14 changes a BD control mode. More specifically, the CPU 14 change the BD control mode from a mode in which laser is continuously emitted to a mode in which laser APC is applied at a fixed time rate with respect to the BD interval acquired in pre-scanning. Thus, when the steady rotation number is almost reached, the CPU 14 changes the control mode to perform APC (defined as unblanking APC) and BD detection in a non-image area.

In step S208, the CPU 14 waits until a predetermined time has elapsed. The predetermined time period includes a time period since the CPU 14 determines that the scanner motor rotation is close to the specified rotation number, until the rotation number is stabilized by repeating overshoot and undershoot to be ready for image formation. According to the present exemplary embodiment, the predetermined time period is set to about 1 second. In step S209, when the predetermined time has elapsed, the scanner becomes ready and then the activation sequence of the exposure device ends.

Figures 17A, 17B, 17C:
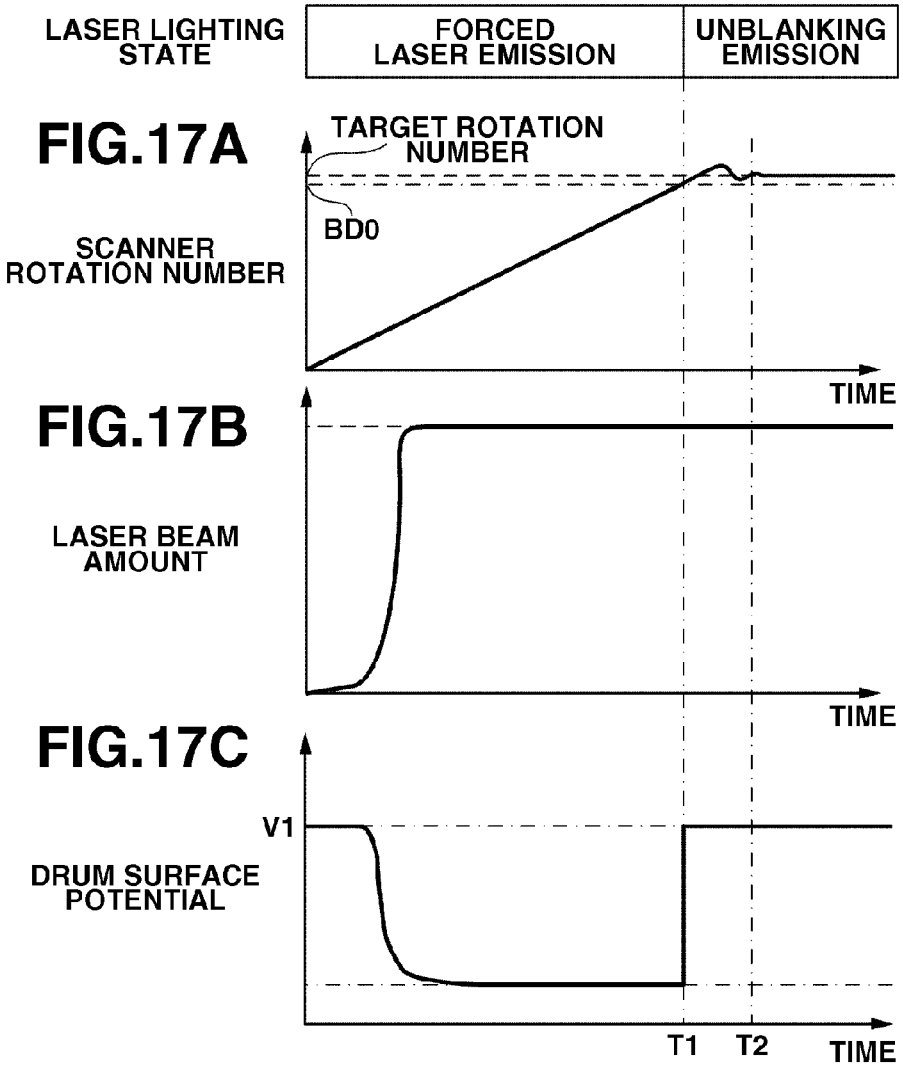
FIGS. 17A to 17C illustrate variation over time in the rotation number of a scanner, a laser beam amount, and a drum surface potential during pre-rotation.
Figure 18:
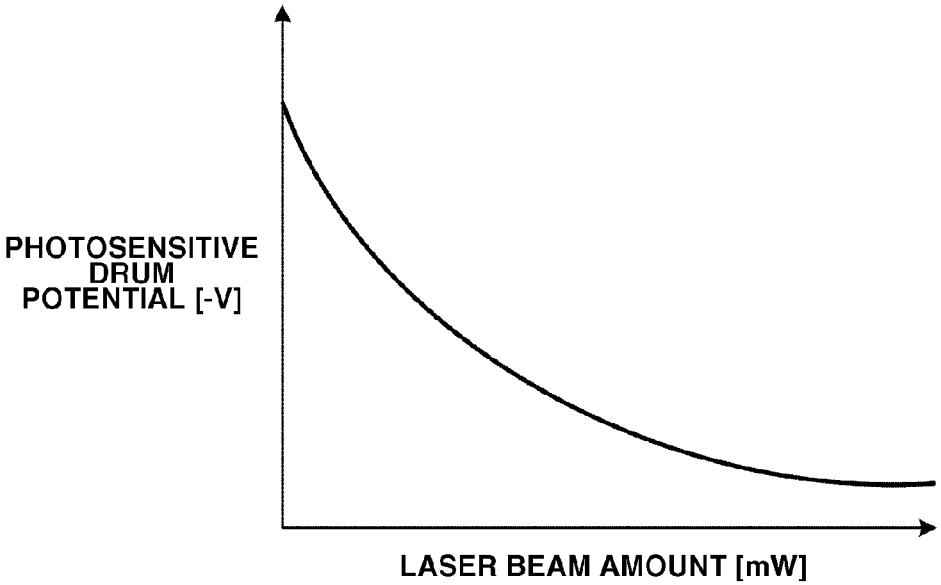
FIG. 18 illustrates a relation between a laser beam amount and a photosensitive drum potential.

FIGS. 17A to 17C illustrate variation over time in the scanner motor rotation number, laser beam amount, and photosensitive drum potential during the activation of the exposure device when the above-described APC and motor rotation control are performed. In the APC and the scanner motor rotation control performed in response to an instruction from the CPU 14, the laser beam amount and scanner motor rotation number vary as illustrated in FIGS. 17A and 17B. A time T1 indicates a time when the scanner motor rotation number reaches a value about −5% of the BD interval at the time of the steady rotation of the scanner motor. A time T2 indicates a time when the exposure device becomes ready. The photosensitive drum 1*y* is charged by the charging roller 2*y* so that the surface potential before exposure becomes V1. When exposed to light from the exposure device, the surface potential varies as illustrated in FIG. 17C according to the laser beam amount-photosensitive drum potential characteristics illustrated in FIG. 18.

Figure 19:
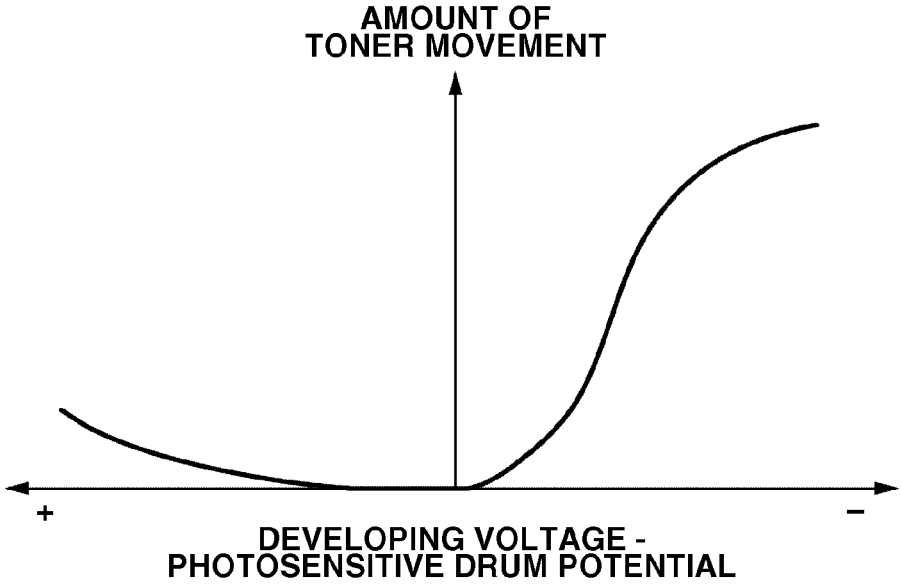
FIG. 19 illustrates a relation between a potential difference between a developing voltage and a photosensitive drum, and an amount of toner movement.

The relation between the potential difference between the developing voltage and the photosensitive drum potential, and the amount of toner movement will be described below. FIG. 19 illustrates the relation between the potential difference between the photosensitive drum potential and the developing voltage, and the amount of toner movement when negative polarity toner is used. When the potential difference acquired by subtracting the photosensitive drum potential from the developing voltage has the same polarity as the toner polarity, toner on the developing roller is developed onto the photosensitive drum. Otherwise, when the potential difference acquired by subtracting the photosensitive drum potential from the developing voltage has the opposite polarity of the toner polarity, toner on the developing roller is not developed onto the photosensitive drum.

However, toner includes inverted toner, i.e., toner charged to the opposite polarity of the normal charging polarity. (The normal charging polarity refers to the charging polarity for developing an electrostatic latent image. According to the present exemplary embodiment, the normal toner charging polarity is the negative polarity since a negatively charged electrostatic latent image is invertedly developed.) The inverted toner may move from the developing roller to the photosensitive drum (hereinafter, this phenomenon is referred to as inverted fogging). When the potential difference acquired by subtracting the photosensitive drum potential from the developing voltage has the opposite polarity of the toner polarity, and the potential difference has the larger absolute value, the inverted fogging is more significant.

Therefore, to prevent toner from moving to the photosensitive drum, it is desirable to set the potential difference acquired by subtracting the photosensitive drum potential from the developing voltage to the opposite polarity of the toner polarity, and to reduce the absolute value thereof to a level at which inverted fogging does not occur.

Figures 20A, 20B, 20C:
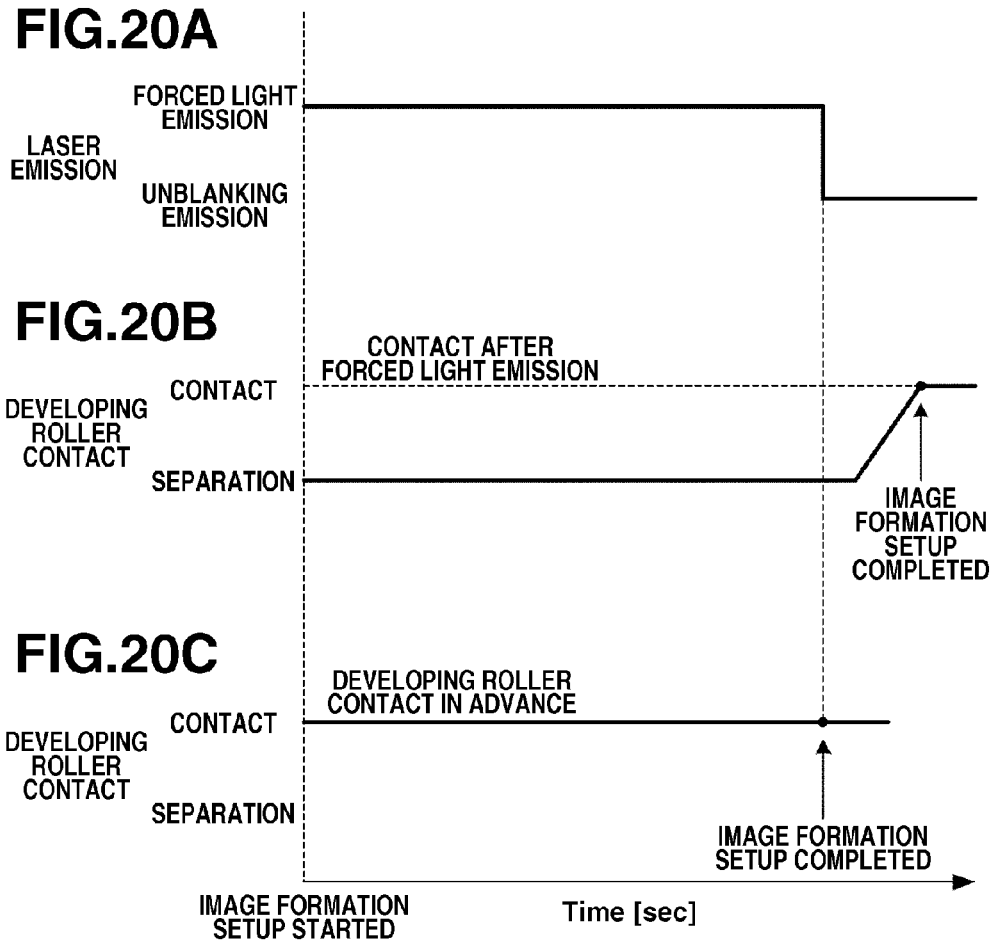
FIGS. 20A to 20C illustrate a developing roller contact timing.

As described above, an electrostatic latent image is formed on the photosensitive drum during the APC (in an adjustment period during which the laser beam output is adjusted while exposing the photosensitive drum to light prior to image formation) since the photosensitive drum is affected by forcible laser emission. Accordingly, the timing that the developing roller is brought into contact with the photosensitive drum is set after completion of the APC and the motor rotation control of the scanner and extinction of the laser on the photosensitive drum surface, so that wasteful toner consumption and stain on the rear surface of paper can be prevented. However, such control prolongs the time period till completion of image formation setup and results in an increase in FPOT, as illustrated in FIG. 20B.

To shorten FPOT, it is desirable to perform control to bring the developing roller into contact with the photosensitive drum in advance before completion of the APC. For reference, the control to bring the developing roller into contact with the photosensitive drum in advance before starting the APC will be described below with reference to FIGS. 20C and 21. First, the CPU 14 pre-acquires a laser beam amount W1 [mW] with which the photosensitive drum potential becomes a predetermined voltage V1. Then, based on the result of laser beam amount monitoring performed during the APC operation, the CPU 14 acquires a timing when a predetermined laser beam amount W1 [mW] is reached.

Figure 21:
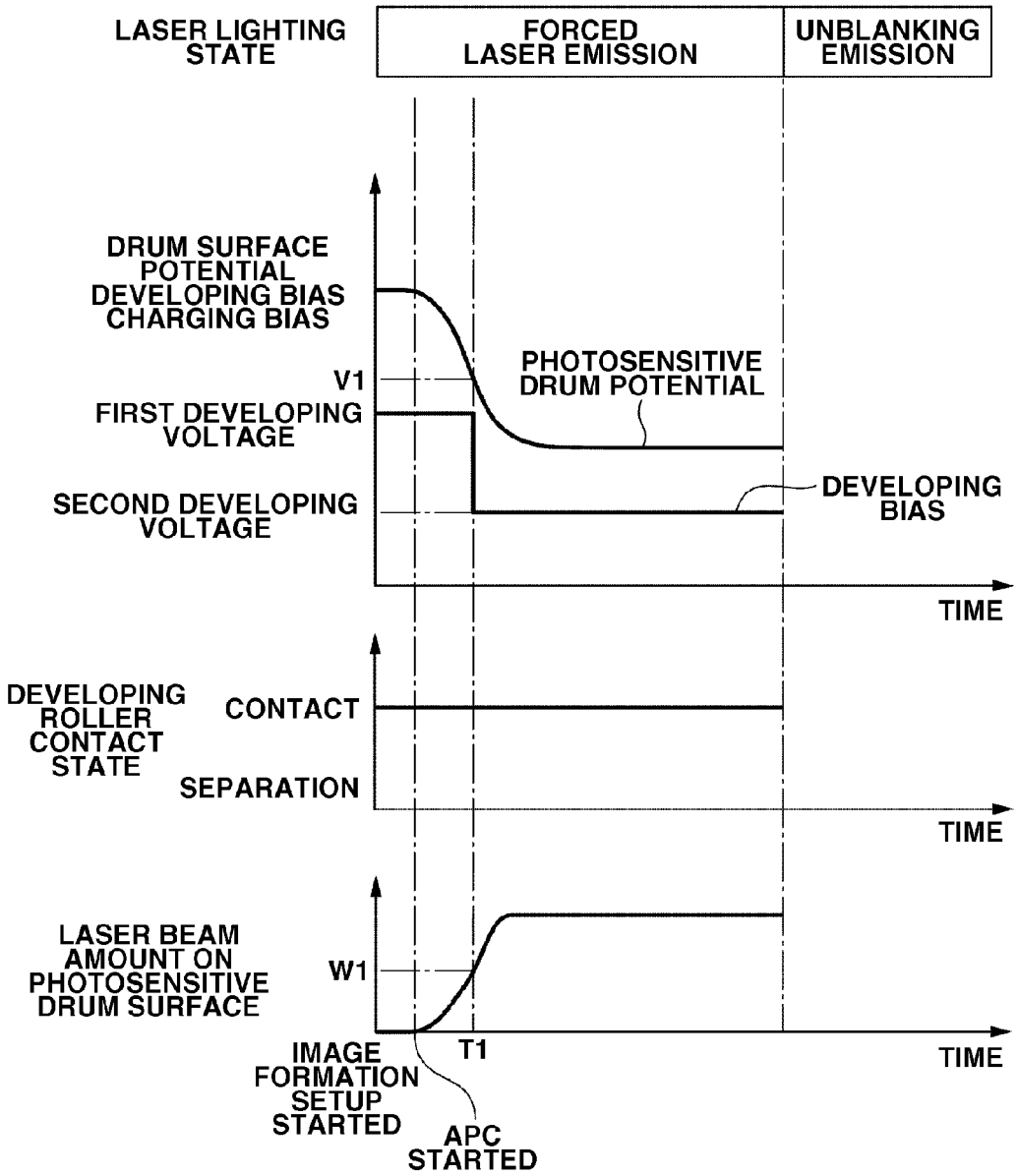
FIG. 21 illustrates a relation among a photosensitive drum potential, a developing voltage, and a developing roller contact timing.

At a timing (T1) when a portion on the photosensitive drum irradiated with the laser beam amount W1 [mW], i.e., a portion where the photosensitive drum potential becomes the predetermined voltage V1, reaches the developing position, the CPU 14 changes the developing voltage to a second developing voltage as illustrated in FIG. 21. There is a time difference between the timing when the predetermined laser beam amount W1 [mW] is reached and the timing when the developing voltage is changed to the second developing voltage according to a distance between the laser irradiation position and the developing roller contact position. This configuration sets the potential difference between the developing voltage and the photosensitive drum potential to the opposite polarity of toner charging polarity, and thus toner development is restrained.

However, the photosensitive drum sensitivity generally varies according to a manufacturing tolerance, a usage environment, and a degree of degradation. More specifically, irradiation of the photosensitive drum with an identical laser beam amount does not necessarily cause an identical photosensitive drum potential illustrated by a solid line a in FIG. 22 but causes variations in photosensitive drum potential as illustrated by broken lines b and c in FIG. 22.

Figure 22:
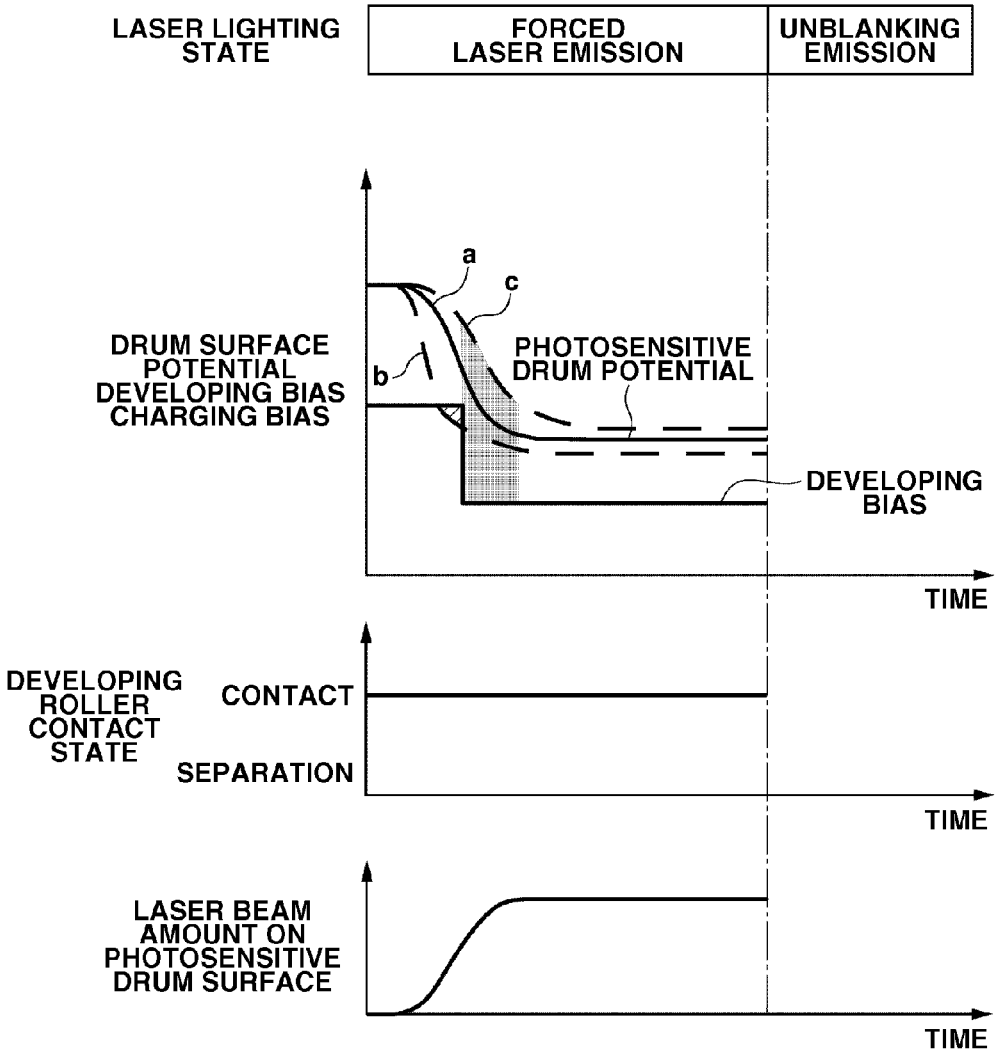
FIG. 22 illustrates a relation among a photosensitive drum potential, a developing voltage, and a developing roller contact timing.

Referring to FIG. 22, in the case of the curve b which indicates that the photosensitive drum sensitivity is higher than the curve a, i.e., the photosensitive drum potential is likely to decrease, an area as indicated by diagonal lines in FIG. 22 is produced, where the potential difference acquired by subtracting the photosensitive drum potential from the developing voltage has the same polarity as the toner polarity, resulting in toner development. Conversely, in the case of the curve c which indicates that the photosensitive drum sensitivity is lower than the curve a, i.e., the photosensitive drum potential is not likely to decrease, an area as indicated by a shaded portion in FIG. 22 is produced. In this area, since the potential difference acquired by subtracting the photosensitive drum potential from the developing voltage has the opposite polarity of the toner polarity and a large absolute value, inverted fogging may occur.

Thus, when the developing roller is constantly in contact with the photosensitive drum before starting the APC, it is necessary to synchronize the voltage to be applied to the developing roller with the photosensitive drum surface potential to prevent toner on the developing roller from moving to the photosensitive drum. However, during pre-rotation, the laser beam amount control (APC) and scanner motor control are performed and therefore the photosensitive drum surface potential largely varies. Accordingly, when taking variation in the photosensitive drum into consideration, it is difficult to restrict the potential difference within a desired range. As a result, there arises an issue that wasteful toner consumption and stain on the rear surface of paper are highly likely to occur.

Figures 23A, 23B, 23C:
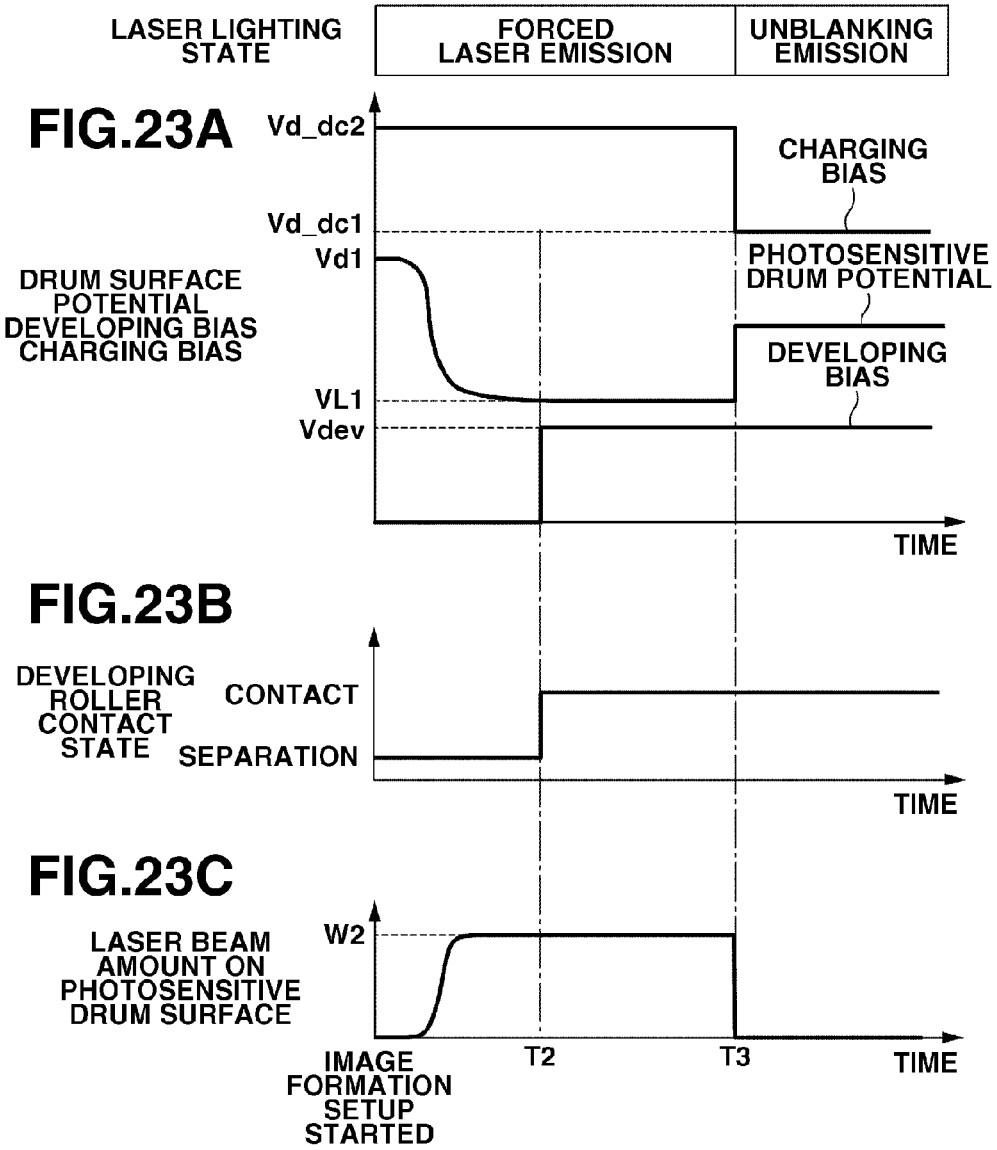
FIGS. 23A to 23C illustrate a relation among a photosensitive drum potential, a developing voltage, and a developing roller contact timing according to a fourth exemplary embodiment.

Thus, according to the present exemplary embodiment, the developing roller is separated from the photosensitive drum (i.e., the separation state) at the start of the APC, and when a predetermined time T2 [second] has elapsed since the laser driving current is applied, the developing roller is brought into contact with the photosensitive drum (i.e., shift to a contact state) as illustrated in FIG. 23A to 23C. In addition, to change the photosensitive drum surface potential to a second photosensitive drum surface potential with which toner is not transferred from the developing roller to the photosensitive drum, a second charging bias, which is different from that during image formation, is applied to the photosensitive drum during the pre-rotation. Taking the variation in the photosensitive drum sensitivity into consideration, the predetermined time T2 is set so that the photosensitive drum potential stabilizes, and the potential difference between the second photosensitive drum potential and the developing voltage (potential of the developing roller) decreases to a level at which inverted fogging does not occur.

Accordingly, wasteful toner consumption and stain on the rear surface of paper can be prevented. Further, since the developing roller can be brought into contact with the photosensitive drum before the APC ends, FPOT can be shortened. Further, the configuration also makes it easier to control the potential difference between the developing roller potential and the photosensitive drum potential to prevent fogging than a case where the developing roller is in contact with the photosensitive drum in advance before starting the APC.

The configuration according to the present exemplary embodiment will be described in detail below. Only the image forming unit Uy for yellow will be described below.

When the image forming apparatus receives a print signal, the photosensitive drum 1*y* starts rotating (image formation setup is started). As described above, the second charging bias, which is different from that at the time of image formation, is applied to the photosensitive drum 1*y* to charge it to a predetermined charging potential. According to the present exemplary embodiment, the charging potential (Vd1) of the photosensitive drum is adjusted to about −800 V, and the second charging bias (Vd_dc2) is adjusted to about −1300 V. Further, according to the present exemplary embodiment, a charging bias (Vd_dc1) at the time of image formation is adjusted to −900 V, and the charged portion potential on the photosensitive drum is adjusted to −400 V.

Figure 24:
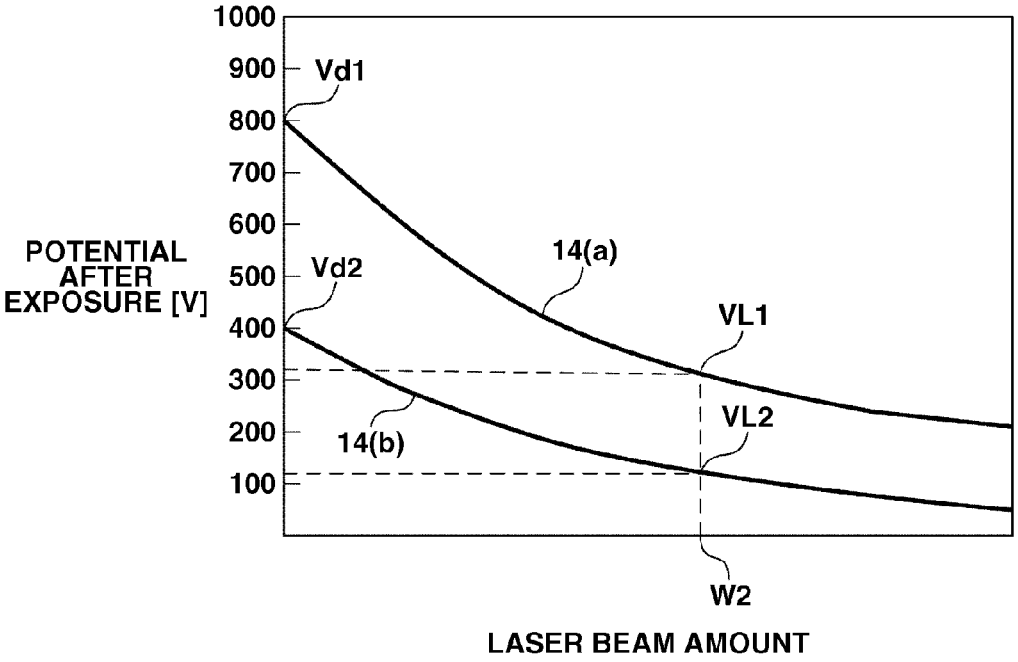
FIG. 24 illustrates a relation between a laser beam amount and a potential after exposure according to the fourth exemplary embodiment.
Figures 25A, 25B, 25C:
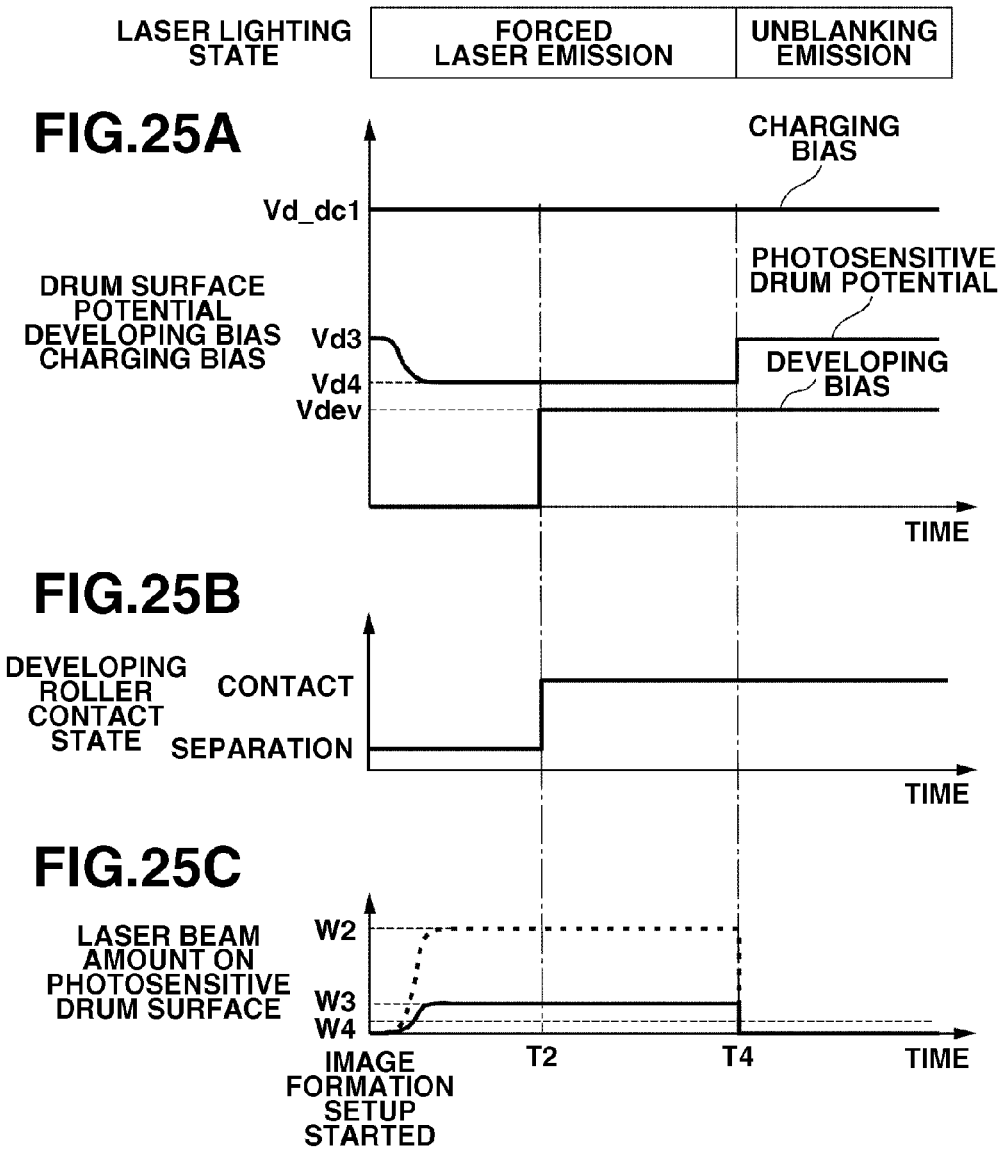
FIGS. 25A to 25C illustrate a relation among a photosensitive drum potential, a developing voltage, and a developing roller contact timing according to a fifth exemplary embodiment.

When a predetermined time has elapsed since the image formation setup is started, the above-described APC is started to suitably adjust the laser beam amount targeting the laser beam amount W2 similar to that during image formation. According to the present exemplary embodiment, during the APC, the potential on the photosensitive drum after exposure is adjusted based on the relation between the laser beam amount and the potential after exposure illustrated in FIG. 24 so that the potential after exposure with a suitable laser beam amount becomes −320 V (VL1) (see 14(a) in FIG. 24). At the time of image formation, the laser beam amount is adjusted so that the potential after exposure becomes −120V (VL2) (see 14 (b) in FIG. 24).

Further, after a predetermined time T2 [second] has elapsed since the image formation setup is started, the developing roller 41*y* is brought into contact with the photosensitive drum 1*y*. In this case, the potential of the developing roller 41*y* is set to −300 V (Vdev) similar to that during image formation. In the predetermined time T, which includes a timing when the developing roller 41*y* and the photosensitive drum 1*y* are changed from the separation state to the contact state, the value acquired by subtracting the photosensitive drum potential from the developing voltage becomes +20 V and has the opposite polarity of the toner charging polarity (negative polarity). Therefore, toner development during execution of the APC (also referred to as regular fogging) does not occur. At a timing (T3) when forcible laser emission is completed and unblanking emission is started, the changed charging bias is changed to a bias (−900 V) for image formation, and the image formation setup is completed.

The predetermined time T2 [second] is determined in consideration of the variation in the photosensitive drum sensitivity. According to the present exemplary embodiment, even when a low-sensitivity photosensitive drum is used, the potential difference between the photosensitive drum and the developing roller in the developing roller contact state is adjusted to 100 V or less. This is because, in the development configuration applied to the present disclosure, inverted fogging can be prevented from occurring by setting the potential difference between the photosensitive drum and the developing roller to 100 V or less. Thus, inverted fogging does not occur if a low-sensitivity photosensitive drum is used.

When the potential difference between the photosensitive drum and the developing roller needs to be 20 V or more to prevent regular fogging, the bias to be applied to the developing roller can be adjusted to acquire a large potential difference. For example, although, in the above-described exemplary embodiment, a −300 V bias is applied to the developing roller similar to that during image formation, if a −250 V bias is applied thereto, a 70 V potential difference can be secured between the photosensitive drum and the developing roller.

As described above, in the predetermined time period including a timing when the developing roller and the photosensitive drum are changed from the separation state to the contact state, the control unit 14 executes a mode for controlling the charging device and exposure device to adjust the photosensitive drum surface potential so that the potential difference acquired by subtracting the photosensitive drum potential at the developing position from the potential of the developing roller has the opposite polarity of the normal toner charging polarity (negative polarity). In this mode, if the developing roller contacts the photosensitive drum during execution of the APC, neither toner development nor inverted fogging occurs. Thus, FPOT can be shortened without wasteful toner consumption and stain on the rear surface of paper.

The present exemplary embodiment is also effective when optical adjustment other than the APC is performed by emitting a laser at the start of image formation. For example, there is a case where synchronization adjustment of the laser write position is performed by detecting apart of the scanning beam via the BD sensor 36 simultaneously with the start of the polygon mirror rotation. In this case, since the laser beam needs to be emitted until the polygon mirror rotation reaches a steady state, a similar issue to that in the APC execution arises. Even in this case, the configuration according to the present exemplary embodiment is effective for FPOT reduction. When the polygon mirror rotation reaches a steady state and subsequently, since the laser is not emitted in the development area (an area corresponding to the width of the developing roller) at the time of non-image formation in the regular operation excluding the APC execution, toner adhesion to the photosensitive drum does not occur.

Although, in the present exemplary embodiment, only the image forming unit Uy for yellow is described, similar control to the present exemplary embodiment may also be applied to the image forming units Um, Uc, and Uk for magenta, cyan, and black, respectively. Further, similar control to the present exemplary embodiment may be applied only to the image forming units arranged on the upstream side which are important for FPOT reduction.

In the fourth exemplary embodiment, toner movement to the photosensitive drum in the developing roller contact state is prevented by differentiating the voltage applied to the charging roller during pre-rotation from the voltage at the time of image formation. In a fifth exemplary embodiment, the laser beam amount during pre-rotation is changed to prevent toner from moving to the photosensitive drum in the developing roller contact state. The present exemplary embodiment will be described in detail below centering on differences from the fourth exemplary embodiment.

According to the present exemplary embodiment, the developing roller is separated from the photosensitive drum 1*y* when he APC is started, and the developing roller is brought into contact with the photosensitive drum 1*y* when a predetermined time T2 [second] has elapsed since printing is started. Further, the amount of laser beam emission is set to a second laser beam amount during pre-rotation so that the photosensitive drum surface potential in the developing roller contact state becomes the second photosensitive drum surface potential with which toner is not developed. Taking the variation in the photosensitive drum sensitivity into consideration, the predetermined time T2 is set so that the potential difference between the second photosensitive drum potential and the developing voltage decreases to a level at which inverted fogging does not occur.

The photosensitive drum potential in the developing roller contact state as the second photosensitive drum potential. Therefore, the potential difference between the developing voltage and the photosensitive drum potential constantly has the opposite polarity of the toner polarity. Thus, toner is not developed during the APC. In addition, since the developing roller is brought into contact with the photosensitive drum when the predetermined time T2 [second] has elapsed since printing is started, the potential difference between the photosensitive drum potential and the developing voltage does not unnecessarily increase, and inverted fogging can be prevented from occurring. Thus, wasteful toner consumption and stain on the rear surface of paper can be prevented. Further, since this configuration enables the developing roller 41*y* to contact the photosensitive drum 1*y* during the APC operation, FPOT can also be shortened.

The configuration according to the present exemplary embodiment will be described in detail below. Only the image forming unit Uy for yellow will be described below.

When the image forming apparatus receives a print signal, the photosensitive drum 1*y* starts rotating. An approximately −1000 V charging bias (Vd_dc1) is applied to the charging roller 2*y* similar to that during image formation, and the surface potential of the photosensitive drum 1*y* becomes about −500 V (Vd3). In addition, the APC is executed to suitably adjust the laser beam amount targeting a second laser beam amount (W3) of 0.25 mW which is different from that at the time of image formation. According to the present exemplary embodiment, the exposed portion potential with a suitable laser beam amount is set to −350 V (VL3). In this case, the second laser beam amount is set so as to exceed a detection limit W4 (0.10 mW) of the BD sensor 36. Thus, the developing roller can be brought into contact with the photosensitive drum during activation of the exposure device.

When the predetermined time T2 [second] has elapsed and the developing roller 41*y* is brought into contact with the photosensitive drum 1*y*, a −250 V bias is set to be applied to the developing roller 41*y* similar to that during image formation. With these settings, the value acquired by subtracting the photosensitive drum potential from the developing voltage becomes +100 V having the opposite polarity of the toner charging polarity (negative polarity). Therefore, toner is not developed during execution of the APC. At a timing when forcible laser emission is completed and unblanking emission is started, a target value of the laser beam amount is changed from 0.25 mW to 0.8 mW to execute unblanking APC. The APC is performed with the same procedures as those described in the fourth exemplary embodiment. When the laser beam amount reaches the target value 0.8 [mW], the laser driving current value is fixed to the relevant value. Then, the APC and the image formation setup are ended.

The predetermined time T2 [second] is determined in consideration of the variation in the photosensitive drum sensitivity. Also in the present exemplary embodiment, similar to the fourth exemplary embodiment, the potential difference between the photosensitive drum and the developing roller in the developing roller contact state is set to 150 V or less, and inverted fogging can be prevented from occurring.

With above-described configuration, if the developing roller contacts the photosensitive drum during execution of the APC, neither toner development nor inverted fogging occurs. Thus, FPOT can be shortened without wasteful toner consumption and stain on the rear surface of paper.

Although, in the present exemplary embodiment, only the image forming unit Uy for yellow is described, similar control to the present exemplary embodiment may also be applied to the image forming units Um, Uc, and Uk for magenta, cyan, and black, respectively. Further, similar control to the present exemplary embodiment may be applied only to the image forming units arranged on the upstream side which are important for FPOT reduction.

As a sixth exemplary embodiment, a case where an atmospheric environment changes. Only the image forming unit Uy for yellow will be described below.

Figure 26:
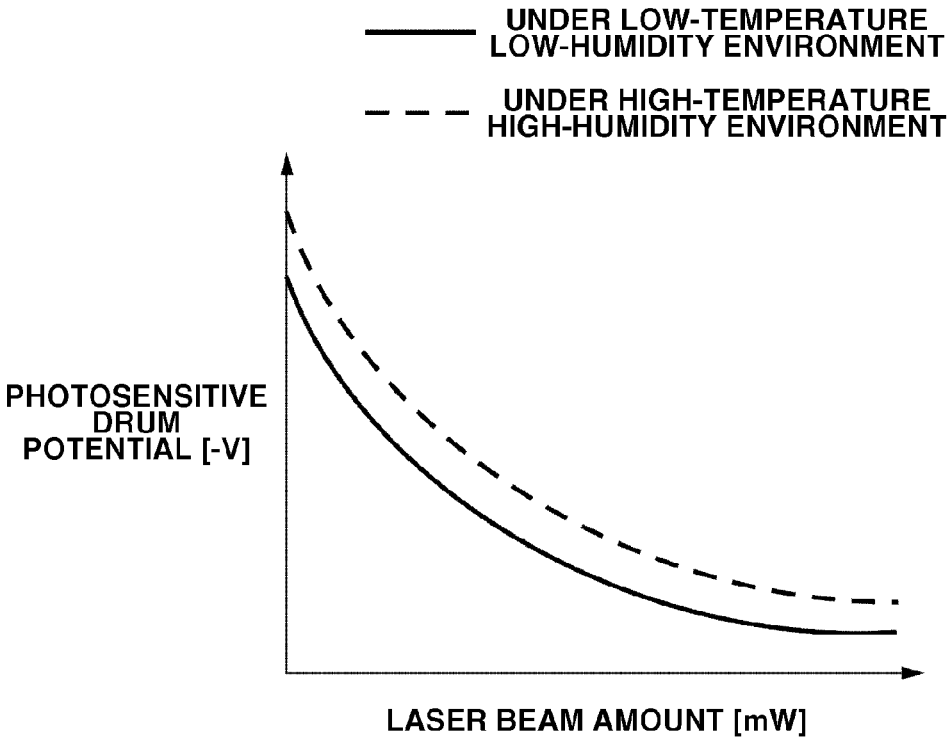
FIG. 26 illustrates a relation between a laser beam amount and a photosensitive drum potential according to a sixth exemplary embodiment.

When the atmospheric environment changes, the member resistance also changes, and accordingly the charging characteristics of the photosensitive drum 1*y* change. Under a high-temperature and high-humidity environment, i.e., in an environment containing high absolute moisture content in air, the member resistance decreases, and accordingly the charging potential of the photosensitive drum 1*y* increases when a constant charging bias is applied to the photosensitive drum 1*y*. On the contrary, under a low-temperature and low-humidity environment, i.e., in an environment containing low absolute moisture content in air, the member resistance increases, and accordingly the charging potential of the photosensitive drum 1*y* decreases. As a result, the exposed portion potential on the photosensitive drum 1*y* also changes depending on the atmospheric environment. Under the high-temperature and high-humidity environment, the exposed portion potential on the photosensitive drum 1*y* increases. Under the low-temperature and low-humidity environment, the exposed portion potential on the photosensitive drum 1*y* decreases. (See FIG. 26) This phenomenon is also applied to the APC operation.

Therefore, if the second developing voltage to be applied when bringing the developing roller 41*y* into contact with the photosensitive drum 1*y* is constant, under the high-temperature and high-humidity environment, the potential difference between the photosensitive drum potential and the developing voltage increases and inverted fogging may occur. Under the low-temperature and low-humidity environment, the potential difference between the photosensitive drum potential and the developing voltage decreases, and there is a fear of causing toner development. The result is wasteful toner consumption and stain on the rear surface of paper.

According to the present exemplary embodiment, therefore, the charging bias is changed according to variation in the atmospheric environment so as to prevent variation in the potential difference between the photosensitive drum potential and the developing voltage even when the charging characteristics of the photosensitive drum change according to the atmospheric environment. More specifically, under the high-temperature and high-humidity environment in which the exposed portion potential increases, the CPU 14 performs correction to decrease the second charging voltage. Under the low-temperature and low-humidity environment in which the exposed portion potential decreases, the CPU 14 performs correction to increase the second charging voltage. With this configuration, control is performed to maintain an approximately constant value of the potential difference between the photosensitive drum potential and developing voltage in the developing roller 41 contact state regardless of the atmospheric environment.

The control will be described in detail below. According to the present exemplary embodiment, the atmospheric environment is detected by the environmental detection device 16 (see FIG. 1). According to consideration by the inventors of the present invention, the charging bias, and the charging potential and exposed portion potential on the photosensitive drum 1y when a −250 V developing bias is applied to the developing roller 2y in each atmospheric environment are as shown in Table 2.

TABLE 2

| | Charging bias | Charging potential | exposed portion potential | developing voltage-photo-sensitive drum potential in developing roller contact state |
|---|---|---|---|---|
| low-temperature low-humidity environment | −1230 V | −730 V | −350 V | +100 V |
| normal-temperature normal-humidity environment | −1200 V | −700 V | −350 V | +100 V |
| high-temperature high-humidity environment | −1170 V | −670 V | −350 V | +100 V |

According to the present exemplary embodiment, the second charging voltage is corrected based on the result of the detection by the environmental detection device 16, as shown in Table 2. Setting the second charging voltage in this way provides a +100 V potential difference between the potential of the photosensitive drum 1y and the developing voltage in the developing roller 41y contact state regardless of the atmospheric environment. Therefore, if the developing roller 41y contacts the photosensitive drum 1y during execution of the APC, neither toner development nor inverted fogging occurs. Thus, FPOT can be shortened without wasteful toner consumption and stain on the rear surface of paper.

Although, in the present exemplary embodiment, the potential difference between the potential of the photosensitive drum 1y and the developing voltage is controlled by changing the charging bias depending on the environment, a similar effect can be acquired also by changing the laser beam amount based on environmental information. More specifically, the laser beam amount may be increased more under the higher-temperature and higher-humidity environment.

The exposed portion potential on the photosensitive drum with respect to the laser beam amount may possibly be changed by the degree of use of the photosensitive drum. As the degree of use of the photosensitive drum increases, the surface of the photosensitive drum 1y is scraped and the film thickness on the photosensitive drum 1y decreases. Accordingly, the capacitance of the photosensitive drum 1y increases and, when a constant charging bias is applied, the charging potential of the photosensitive drum 1y increases. As a result, the relation between the laser beam amount and the photosensitive drum potential also changes.

Therefore, a similar effect to the above-described case can be acquired by decreasing the absolute value of the charging bias or increasing the laser beam amount as the degree of use of the photosensitive drum increases. Thus, neither toner development nor inverted fogging occurs. Further, FPOT can be shortened without wasteful toner consumption and stain on the rear surface of paper. The degree of use of the photosensitive drum may be determined based on the number of sheets used for printing (number of sheets used for image formation) by the image forming unit, the rotation number of the photosensitive drum 1y, and the time period during which the charging bias is applied to the charging roller 2y.

Although, in the present exemplary embodiment, only the image forming unit Uy for yellow is described, similar control to the present exemplary embodiment may also be applied to the image forming units Um, Uc, and Uk for magenta, cyan, and black, respectively. Further, similar control to the present exemplary embodiment may be applied only to the image forming units arranged on the upstream side which are important for FPOT reduction.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2011-235136 filed Oct. 26, 2011, No. 2011-235137 filed Oct. 26, 2011, and No. 2012-208468 filed Sep. 21, 2012, which are hereby incorporated by reference herein in their entirety.

What is claimed is:

1. An image forming apparatus comprising:

an image bearing member;

an exposure device configured to expose the image bearing member to light to form an electrostatic latent image on the image bearing member, the exposure device emits light to the image bearing member during a light emitting period prior to image formation;

a voltage application device configured to apply a voltage to a toner bearing member; and a developing device configured to include the toner bearing member for bearing toner, to change between a contact state where the image bearing member and the toner bearing member are in contact with each other and a separation state where they are separated from each other, and to develop the electrostatic latent image by toner on the toner bearing member in the contact state, wherein, if a portion on the image bearing member exposed to light in the light emitting period is at a developing position, the developing device changes from the separation state to the contact state, wherein, in a predetermined time period including a timing of changeover from the separation state to the contact state, the voltage application device applies a voltage to the toner bearing member so a potential difference acquired by subtracting a potential of the image bearing member at the developing position from a potential of the toner bearing member has an opposite polarity of a normal toner charging polarity.

2. The image forming apparatus according to claim 1, wherein, in the predetermined time period the voltage application device applies a voltage to the toner bearing member so a potential of the toner bearing member has the same polarity as a normal toner charging polarity.

3. The image forming apparatus according to claim 1, wherein the developing device changes from the separation state to the contact state after a predetermined time has elapsed from when the light emitting period starts.

4. The image forming apparatus according to claim 1, wherein the voltage application device changes the voltage applied to the toner bearing member in the predetermined time period based on information about a degree of use of the image bearing member.

5. The image forming apparatus according to claim 4, wherein the information about the degree of use of the image bearing member is a number of sheets used for image formation.

6. The image forming apparatus according to claim 4, wherein the information about the degree of use of the image bearing member is a rotation number of the image bearing member.

7. The image forming apparatus according to claim 4, wherein the information about the degree of use of the image bearing member is a time period during which a charging bias is applied to a charging member for charging the image bearing member.

8. The image forming apparatus according to claim 1, further comprising:

a detection device configured to detect a usage environment of the image forming apparatus, wherein the voltage application device changes the voltage applied to the toner bearing member in the predetermined time period based on a result of detection by the detection device.

9. The image forming apparatus according to claim 1, further comprising:

a light emitting unit provided to the exposure device, configured to emit light;

wherein a polygon mirror provided to the exposure device and the exposure device irradiate the image bearing member by reflecting a light emitted from the light emitting unit with the polygon mirror which rotates, and wherein the light emitting period is included in a period while a rotation of the polygon mirror is not in a steady state.

10. An image forming apparatus comprising:

an image bearing member;

an exposure device configured to expose the image bearing member to light to form an electrostatic latent image on the image bearing member, the exposure device emits light to the image bearing member during a light emitting period prior to image formation;

a developing device configured to include a toner bearing member for bearing toner, to change between a contact state where the image bearing member and the toner bearing member are in contact with each other and a separation state where they are separated from each other, and to develop the electrostatic latent image by toner on the toner bearing member in the contact state, wherein, if a portion on the image bearing member exposed to light in the light emitting period is at a developing position, the developing device changes from the separation state to the contact state; and a voltage application device configured to apply a voltage to the toner bearing member, wherein the voltage application device applies a voltage to the toner bearing member so that a potential difference acquired by subtracting a potential of the toner bearing member at a time of image formation from a potential of the toner bearing member in a predetermined time period including a timing of changeover from the separation state to the contact state has an opposite polarity of a normal toner charging polarity.

11. The image forming apparatus according to claim 10, further comprising:

a light emitting unit provided to the exposure device, configured to emit light;

wherein a polygon mirror provided to the exposure device and the exposure device irradiate the image bearing member by reflecting a light emitted from the light emitting unit with the polygon mirror which rotates, and wherein the light emitting period is included in a period while a rotation of the polygon mirror is not in a steady state.

12. An image forming apparatus comprising:

an image bearing member;

an exposure device configured to expose the image bearing member to light to form an electrostatic latent image on the image bearing member, the exposure device emits light to the image bearing member during a light emitting period prior to image formation;

a developing device configured to include a toner bearing member for bearing toner, to change between a contact state where the image bearing member and the toner bearing member are in contact with each other and a separation state where they are separated from each other, and to develop the electrostatic latent image by toner on the toner bearing member in the contact state, wherein, if a portion on the image bearing member exposed to light in the light emitting period is at a developing position, the developing device changes from the separation state to the contact state; and a charging device configured to charge a surface of the image bearing member; and a control unit configured to control the charging device and the exposure device, wherein, in a predetermined time period including a timing of changeover from the separation state to the contact state, the control unit controls the charging device and the exposure device to execute a mode for adjusting a surface potential of the image bearing member so a potential difference acquired by subtracting the surface potential of the image bearing member at the developing position from a potential of the toner bearing member has an opposite polarity of a normal toner charging polarity.

13. The image forming apparatus according to claim 12, wherein, in the mode, the control unit adjusts the surface potential based on information about a degree of use of the image bearing member.

14. The image forming apparatus according to claim 13, wherein the information about the degree of use of the image bearing member is a number of sheets used for image formation.

15. The image forming apparatus according to claim 13, wherein the information about the degree of use of the image bearing member is a rotation number of the image bearing member.

16. The image forming apparatus according to claim 13, wherein the information about the degree of use of the image bearing member is a time period during which a charging bias is applied to a charging member included in the charging device.

17. The image forming apparatus according to claim 12, further comprising:

a detection device configured to detect a usage environment of the image forming apparatus, wherein, in the mode, the control unit adjusts the surface potential based on a result of detection by the detection device.

18. The image forming apparatus according to claim 12, further comprising:

a light emitting unit provided to the exposure device, configured to emit light;

wherein a polygon mirror provided to the exposure device and the exposure device irradiate the image bearing member by reflecting a light emitted from the light emitting unit with the polygon mirror which rotates, and wherein the light emitting period is included in a period while a rotation of the polygon mirror is not in a steady state.

19. An image forming apparatus comprising:

an image bearing member;

an exposure device configured to expose the image bearing member to light to form an electrostatic latent image on the image bearing member, the exposure device emits light to the image bearing member during a light emitting period prior to image formation;

a developing device configured to include a toner bearing member for bearing toner, to change between a contact state where the image bearing member and the toner bearing member are in contact with each other and a separation state where they are separated from each other, and to develop the electrostatic latent image by toner on the toner bearing member in the contact state, wherein, if a portion on the image bearing member exposed to light in the light emitting period is at a developing position, the developing device changes from the separation state to the contact state; and a charging device configured to charge a surface of the image bearing member; and a control unit configured to control the charging device and the exposure device, wherein the developing device changes from the separation state to the contact state with respect to a position on the image bearing member charged by the charging device using a charging bias having the same polarity as polarity at the time of image formation and a greater absolute value than at a time of image formation.

20. The image forming apparatus according to claim 19, further comprising:

a light emitting unit provided to the exposure device, configured to emit light;

wherein a polygon mirror provided to the exposure device and the exposure device irradiate the image bearing member by reflecting a light emitted from the light emitting unit with the polygon mirror which rotates, and wherein the light emitting period is included in a period while a rotation of the polygon mirror is not in a steady state.

21. An image forming apparatus comprising:

an image bearing member;

an exposure device configured to expose the image bearing member to light to form an electrostatic latent image on the image bearing member, the exposure device emits light to the image bearing member during a light emitting period prior to image formation;

a developing device configured to include a toner bearing member for bearing toner, to change between a contact state where the image bearing member and the toner bearing member are in contact with each other and a separation state where they are separated from each other, and to develop the electrostatic latent image by toner on the toner bearing member in the contact state, wherein, if a portion on the image bearing member exposed to light in the light emitting period is at a developing position, the developing device changes from the separation state to the contact state, wherein a target output of the exposure device in the light emitting period is smaller than an output of the exposure device at a time of image formation.

22. The image forming apparatus according to claim 21, further comprising:

a sensor configured to detect light from the exposure device to adjust a position at which the exposure device starts exposing the image bearing member to light, wherein the target output is greater than a detection limit of the sensor.

23. The image forming apparatus according to claim 21, further comprising:

a light emitting unit provided to the exposure device, configured to emit light;

wherein a polygon mirror provided to the exposure device and the exposure device irradiate the image bearing member by reflecting a light emitted from the light emitting unit with the polygon mirror which rotates, and wherein the light emitting period is included in a period while a rotation of the polygon mirror is not in a steady state.

24. An image forming apparatus comprising:

an image bearing member;

an exposure device configured to expose the image bearing member to light to form an electrostatic latent image on the image bearing member, the exposure device emits light to the image bearing member during a light emitting period prior to image formation;

a voltage application device configured to apply a voltage to a toner bearing member; and a developing device configured to include the toner bearing member for bearing toner, to change between a contact state where the image bearing member and the toner bearing member are in contact with each other and a separation state where they are separated from each other, and to develop the electrostatic latent image by toner on the toner bearing member in the contact state, wherein the developing device changes from the separation state to the contact state during the light emitting period, wherein, when the toner bearing member contacts the image bearing member in the light emitting period, the voltage application device applies a voltage to the toner bearing member so that a potential difference acquired by subtracting a potential of the image bearing member at the developing position from a potential of the toner bearing member has an opposite polarity of a normal toner charging polarity.

25. The image forming apparatus according to claim 24, further comprising:

a light emitting unit provided to the exposure device, configured to emit light;

wherein a polygon mirror provided to the exposure device and the exposure device irradiate the image bearing member by reflecting a light emitted from the light emitting unit with the polygon mirror which rotates, and wherein the light emitting period is included in a period while a rotation of the polygon mirror is not in a steady state.

* * * * *